US010691039B2

(12) United States Patent
Iriyama et al.

(10) Patent No.: US 10,691,039 B2
(45) Date of Patent: Jun. 23, 2020

(54) CHARGE REMOVAL PROCESS IN IMAGE FORMING APPARATUS

(71) Applicant: Brother Kogyo Kabushiki Kaisha, Nagoya-shi, Aichi-ken (JP)

(72) Inventors: Shota Iriyama, Nagoya (JP); Kazutoshi Kotama, Nagoya (JP); Chieko Mimura, Nagoya (JP); Kengo Yada, Nagoya (JP); Hotaka Kakutani, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 220 days.

(21) Appl. No.: 15/901,457

(22) Filed: Feb. 21, 2018

(65) Prior Publication Data

US 2018/0284634 A1 Oct. 4, 2018

(30) Foreign Application Priority Data

Feb. 24, 2017 (JP) ..... 2017-033705

(51) Int. Cl.

| | |
|---|---|
| ***G03G 15/08*** | (2006.01) |
| ***G03G 15/043*** | (2006.01) |
| ***G03G 21/00*** | (2006.01) |
| ***G03G 15/00*** | (2006.01) |
| ***G03G 15/02*** | (2006.01) |

(52) U.S. Cl.

CPC ..... *G03G 15/0266* (2013.01); *G03G 15/043* (2013.01); *G03G 15/0808* (2013.01)

(58) Field of Classification Search

CPC ..... G03G 15/0225; G03G 21/06; G03G 15/0266; G03G 15/0813; G03G 15/043; G03G 15/0808; G03G 15/081; G03G 15/0812; G03G 15/1615; G03G 21/0011; G03G 15/0865; G03G 15/80;

(Continued)

(56) References Cited

U.S. PATENT DOCUMENTS

2009/0022517 A1 1/2009 Kanai et al.

FOREIGN PATENT DOCUMENTS

JP 56101161 A * 8/1981 ..... G03G 15/226
JP 2002162876 A 6/2002

(Continued)

*Primary Examiner* — Susan S Lee
(74) *Attorney, Agent, or Firm* — Banner & Witcoff, Ltd.

(57) ABSTRACT

An image forming apparatus executes reverse charging, toner-supply suspension, second exposure, and second charging, while a photosensitive member rotates at least a full turn. In the reverse charging, a charger charges a portion of a circumferential surface of the photosensitive member to a specified polarity. In the toner-supply suspension, before the portion, which has been charged to the second polarity in the reverse charging, of the circumferential surface of the photosensitive member passes a position at which the developer from the developing unit is configured to initially adhered to the circumferential surface, a developing unit stops supplying developer to the circumferential surface. In the second exposure, an exposure device exposes the portion, which has been charged to the specified polarity in the reverse charging, of the circumferential surface. In the second charging the charger charges the portion, which has been exposed in the second exposure, of the circumferential surface.

13 Claims, 15 Drawing Sheets

(58) Field of Classification Search
CPC ..... G03G 15/0131; G03G 15/0126; G03G 15/011; G03G 15/0121
See application file for complete search history.

(56) References Cited

FOREIGN PATENT DOCUMENTS

| | | | |
|---|---|---|---|
| JP | 200942738 | A | 2/2009 |
| JP | 2016142856 | A | 8/2016 |

* cited by examiner

REVERSE CHARGING

SECOND EXPOSURE

SECOND EXPOSURE

SECOND CHARGING

SECOND CHARGING

CHARGE REMOVAL PROCESS IN IMAGE FORMING APPARATUS

CROSS-REFERENCE TO RELATED APPLICATION

This application claims priority from Japanese Patent Application No. 2017-033705 filed on Feb. 24, 2017, the content of which is incorporated herein by reference in its entirety.

TECHNICAL FIELD

Aspects disclosed herein relate to an image forming apparatus including a photosensitive member, a method of controlling the image forming apparatus, and a non-transitory computer-readable storage medium storing a program.

BACKGROUND

In known electrophotographic image forming apparatuses, for example, slide contact of a cleaning member or a charge roller relative to a circumferential surface of a photosensitive member causes generation of charges in the photosensitive member, and the generated charges tend to stay and accumulate in the photosensitive member, which may further cause chargeability degradation and/or ghost printing. In order to solve such problems, in one known technique, when power of an image forming apparatus is turned on, charges accumulated in a photosensitive member are removed through exposure of the photosensitive member to a greater exposure than that applied to the photosensitive member in image formation. In another known technique, during an interval between image formation events, charges accumulated in a photosensitive member are removed through charging of a circumferential surface of the photosensitive member while the photosensitive member rotates one or more full (e.g., 360 degrees) turns. In the meantime, a developing roller is kept separated from the photosensitive member, a transfer bias application is stopped, and a static eliminator is caused to be inactivated.

SUMMARY

According to one or more aspects described herein, an image forming apparatus is provided. The image forming apparatus may include an image forming unit and a controller electrically connected to the image forming unit. The image forming unit may include a photosensitive member, a charger, an exposure device, a developing unit, and a transfer member. The photosensitive member may have a photosensitive layer. The charger may be configured to charge a circumferential surface of the photosensitive member to a first polarity. The exposure device may comprise a light source. The exposure device may be configured to expose the circumferential surface of the photosensitive member. The developing unit may be configured to supply developer onto the circumferential surface of the photosensitive member. The transfer member may be configured to transfer the developer onto a recording medium from the circumferential surface of the photosensitive member. The image forming unit may be configured to perform a printing process. The printing process may include a first charging, a first exposure and a transferring. The transferring may include transferring a developer image onto the recording medium. The controller may be configured to perform reverse charging, while the photosensitive member rotates at least a full turn. The reverse charging may include charging the portion of the circumferential surface of the photosensitive member to a second polarity opposite to the first polarity, in a period different from an execution period of the transferring of the printing process. The controller may be configured to perform toner-supply suspension before the portion, which has been charged to the second polarity in the reverse charging, of the circumferential surface of the photosensitive member passes a position at which developer from the developing unit is configured to initially adhere to the circumferential surface of the photosensitive member. The toner-supply suspension may include controlling the developing unit to stop supplying the developer to the circumferential surface of the photosensitive member. The controller may be configured to perform second exposure while the photosensitive member rotates at least a full turn. The second exposure may include controlling the exposure device to expose the portion, which has been charged to the second polarity in the reverse charging, of the circumferential surface of the photosensitive member. The controller may be configured to perform second charging while the photosensitive member rotates at least a full turn. The second charging may include controlling the charger to charge the portion, which has been exposed in the second exposure, of the circumferential surface of the photosensitive member to the first polarity.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

First Illustrative Embodiment

A first illustrative embodiment will be described with reference to appropriate accompanying drawings. In the description below, an overall configuration of a color printer 1 (as an example of an image forming apparatus) will be described, and various features will be then described in detail. The color printer 1 may be a color laser printer.

Figure 1:
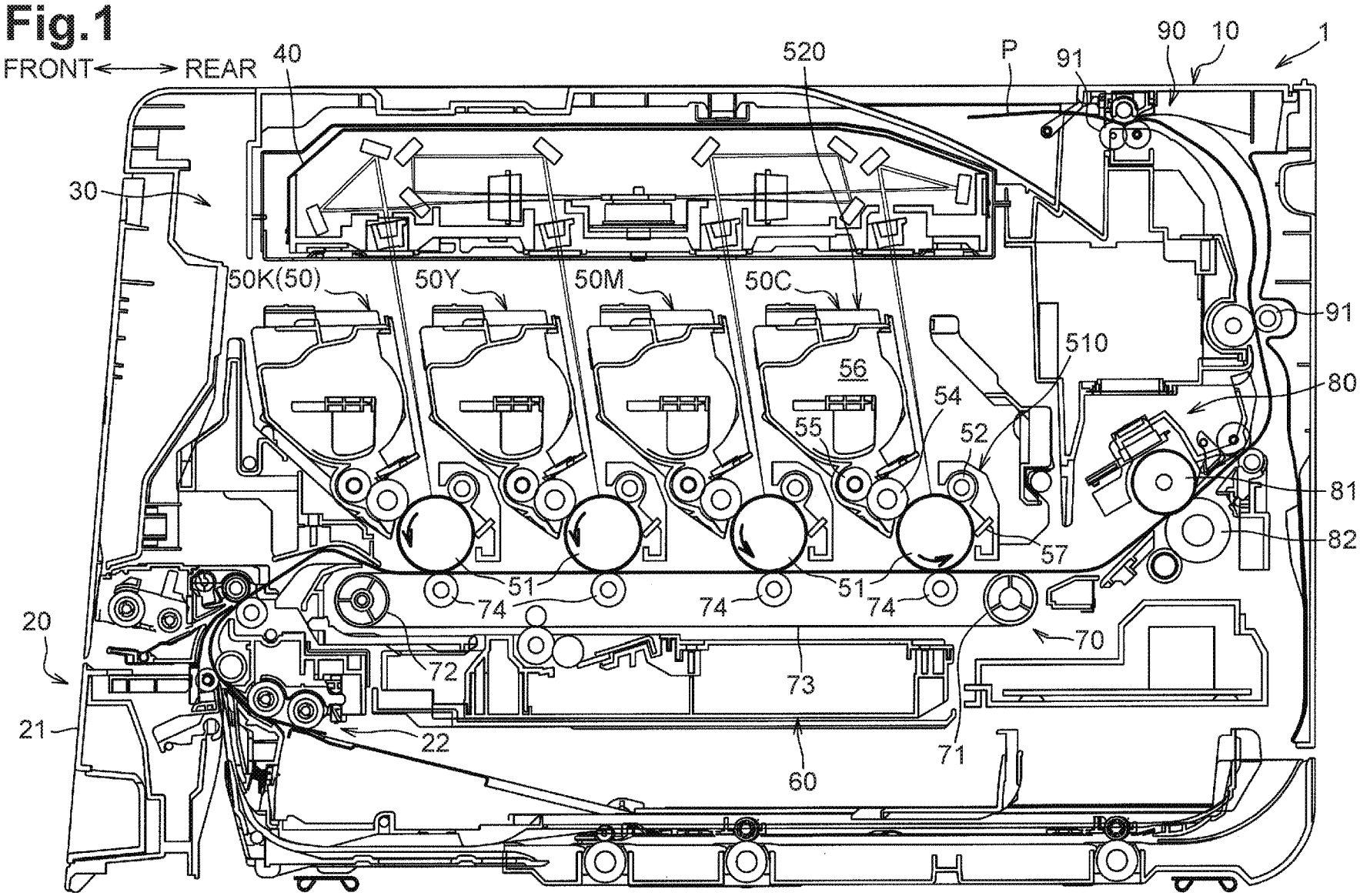
FIG. 1 is a sectional view illustrating a color printer in a first illustrative embodiment according to one or more aspects of the disclosure.

In the description below, as illustrated in FIG. 1, the right and left of FIG. 1 are defined as the rear and front, respectively, of the color printer 1. The right and left of the color printer 1 are defined as viewed from the front of the color printer 1. A top-bottom direction is defined with reference to an orientation of the color printer 1 in which it may be intended to be used.

As illustrated in FIG. 1, the color printer 1 includes a housing 10, a feed unit 20, an image forming unit 30, and a discharge unit 90 in housing 10. The feed unit 20 is configured to feed one or more sheets P (an example of a transfer-receiving medium). The image forming unit 30 is configured to form an image onto a fed sheet P. The discharge unit 90 is configured to discharge a sheet P having an image to the outside of the housing 10.

The feed unit 20 includes a feed tray 21 and a sheet conveyor 22. The feed tray 21 is configured to support one or more sheets P. The sheet conveyor 22 is configured to convey sheets P one by one from the feed tray 21.

The image forming unit 30 includes a scanner 40 (an example of an exposure device), a plurality of process units 50, a transfer unit 70, a cleaning unit 60, and a fixing unit 80.

The scanner 40 is disposed above the plurality of process units 50, and includes laser sources (not illustrated), a polygon mirror, lenses, and reflectors. In the scanner 40, a laser beam is emitted from each of the laser sources. The emitted laser beam travels to a circumferential surface of a corresponding photosensitive drum 51 (as an example of a photosensitive member) while being reflected off the polygon mirror and one or more of the reflectors and passing through the lenses. Thus, the laser beam scans the circumferential surface of the corresponding photosensitive drum 51 at a high scanning speed.

The process units 50 are disposed in tandem in the front-rear direction. Each of the process units 50 includes a drum unit 510 and a developing unit 520. The developing unit 520 is attachable to and detachable from the drum unit 510.

The drum unit 510 includes a photosensitive drum 51, a charge roller 52 (as an example of a charger and a reverse charger), and a cleaning blade 57. The developing unit 520 includes a developing roller 54, a supply roller 55, and a toner chamber 56. The toner chamber 56 is configured to store toner (an example of developer).

The process units 50 includes process units 50K, 50Y, 50M, and 50C which store toner of respective colors, e.g., black (K), yellow (Y), magenta (M), and cyan (C), respectively. In one example, the process units 50K, 50Y, 50M, and 50C are disposed in tandem in this order from upstream in a direction in which a sheet P is conveyed. In the description below and the accompanying drawings, when the same or similar components (e.g., the photosensitive drums 51 and the developing rollers 54) are distinguished by toner color, specific letters K, Y, M, and C representing respective toner colors are appended to their reference numerals. Otherwise, the specific letters Y M, C, and K are omitted. In the description below, a plurality of the same components have the same or similar configuration and function in the same or similar manner to each other. Therefore, one of the plurality of same components may be described in detail, and description for the others may be omitted.

Figure 3:
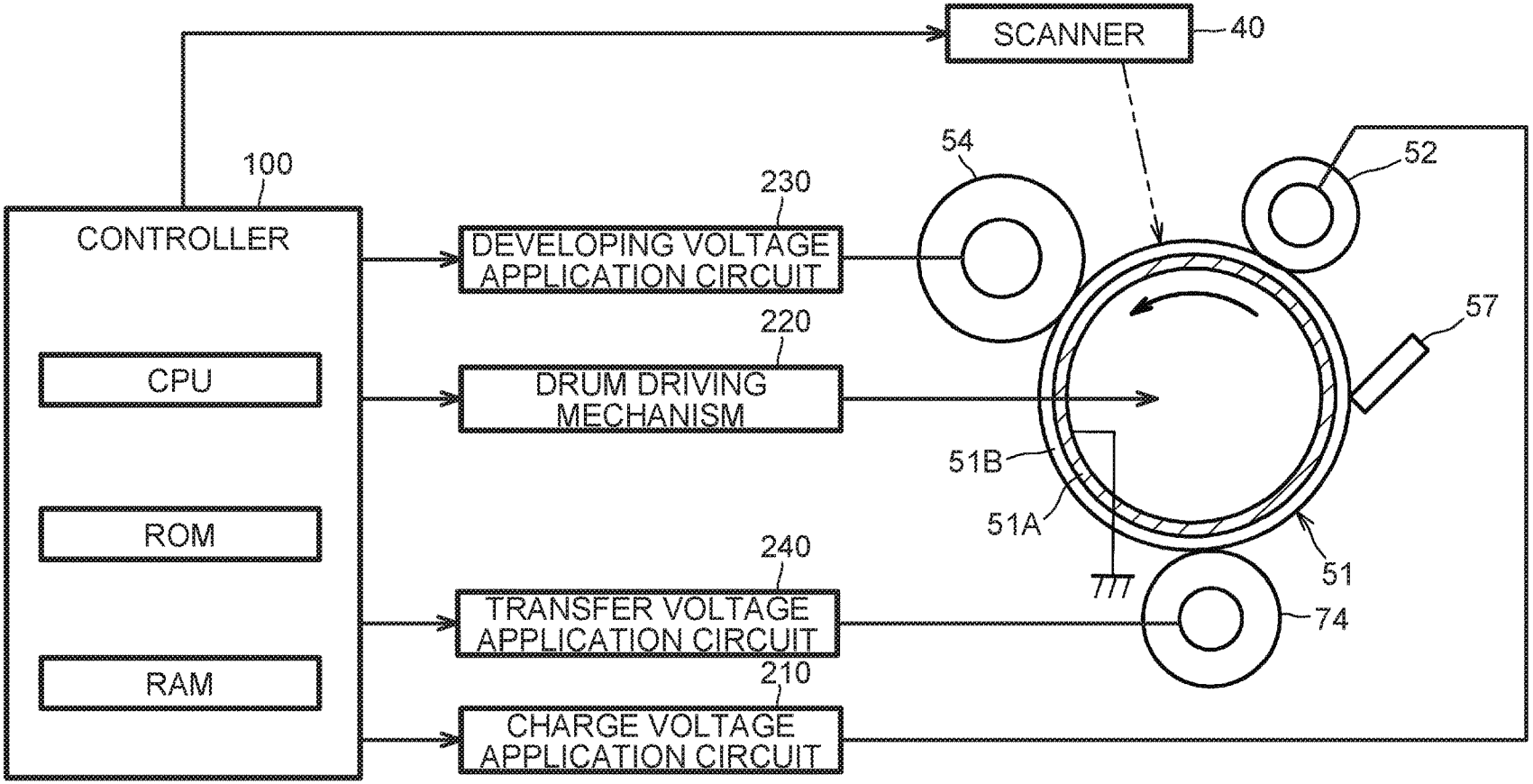
FIG. 3 illustrates an internal configuration of the color printer in the first illustrative embodiment according to one or more aspects of the disclosure.

As illustrated in FIG. 3, the photosensitive drum 51 includes a cylindrical base 51A, and a photosensitive layer 51B formed on an outer circumferential surface of the cylindrical base 51A. The cylindrical base 51A may be made of a conductive member such as metal. The photosensitive layer 51B may be a positively-chargeable organic photosensitive layer containing a charge generating material, an electron transport material, a hole transport material, and a binder resin. The cylindrical base 51A is connected to a ground potential portion of the color printer 1.

The charge roller 52 is configured to charge the circumferential surface of the photosensitive drum 51. The charge roller 52 is in contact with the circumferential surface of the photosensitive drum 51. The charge roller 52 is configured to be applied with a positive charge voltage in charging.

The developing roller 54 may contact the circumferential surface of the photosensitive drum 51 to supply toner onto an electrostatic latent image formed on the circumferential surface of the photosensitive drum 51 to develop the electrostatic latent image with toner. In the illustrative embodiment, when the developing roller 54 supplies toner onto the circumferential surface of the photosensitive drum 51, toner is positively charged by friction caused by sliding of the developing roller 54 and the supply roller 55 relative to each other.

Figure 2:
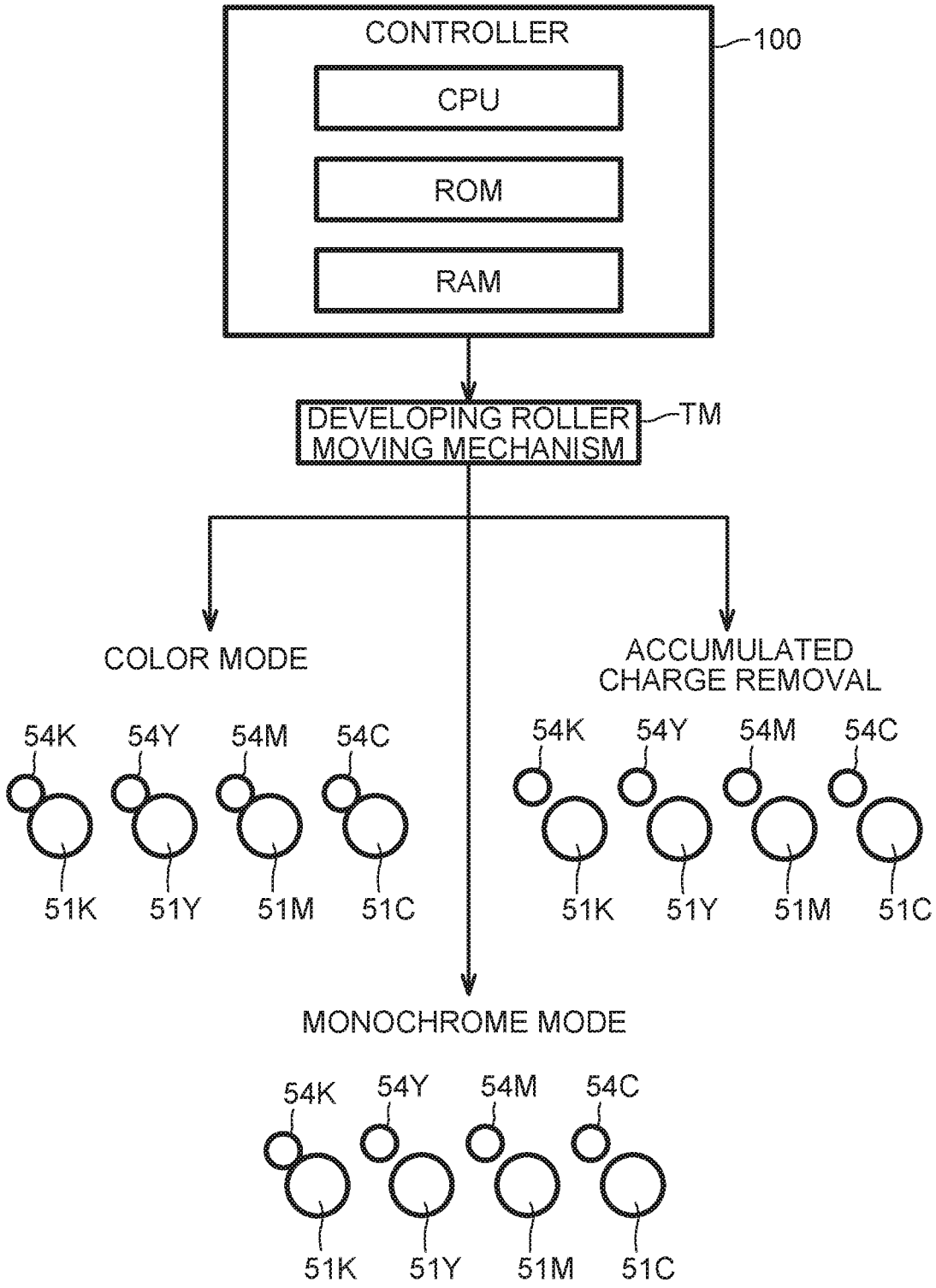
FIG. 2 is a diagram for explaining a contacting and separating manner of developing rollers relative to corresponding photosensitive drums in the first illustrative embodiment according to one or more aspects of the disclosure.

The color printer 1 further includes a developing roller moving mechanism TM. As illustrated in FIG. 2, the developing rollers 54 are configured to contact and separate from the respective photosensitive drums 51 by the developing roller moving mechanism TM that is controlled by a controller 100 of the color printer 1. The developing roller moving mechanism TM is electrically connected to the controller 100. More specifically, for example, in a color mode, all of the developing rollers 54K, 54Y, 54M, and 54C contact the photosensitive drums 51K, 51Y, 51M, and 51C, respectively, to supply toner of respective colors to the corresponding photosensitive drums 51K, 51Y, 51M, and 51C. In a monochrome mode, while the black developing roller 54K contacts the photosensitive drum 51K, the other developing rollers 54Y, 54M, and 54C are kept separated from the photosensitive drums 51Y, 51M, and 51C, respectively. In accumulated charge removal, all of the developing rollers 54K, 54Y, 54M, and 54C are kept separated from the photosensitive drums 51K, 51Y, 51M, and 51C, respectively.

The cleaning blade 57 is configured to collect foreign matters, e.g., toner, adhering to the photosensitive drum 51.

As illustrated in FIG. 1, the cleaning blade 57 is in contact with the circumferential surface of the photosensitive drum 51.

The transfer unit 70 is disposed between the feed unit 20 and the plurality of process units 50 in the top-bottom direction. The transfer unit 70 includes a drive roller 71, a driven roller 72, a conveying belt 73, and transfer rollers 74 (each of which is an example of an example of a transfer member).

The drive roller 71 and the driven roller 72 extend parallel to each other while being spaced apart from each other in the front-rear direction. The conveying belt 73, e.g., an endless belt, is looped around the drive roller 71 and the driven roller 72. The conveying belt 73 has an outer circumferential surface, which is in contact with the circumferential surfaces of the photosensitive drums 51. The transfer rollers 74 (e.g., four transfer rollers 74) are disposed inside a loop of the conveying belt 73 while being opposite to the respective photosensitive drums 51 relative to the conveying belt 73. Each photosensitive drum 51/transfer roller 74 pair sandwiches the conveying belt 73 therebetween. Each of the transfer rollers 74 is configured to be applied with a negative charge voltage in transferring.

As illustrated in FIG. 1, in each of the process units 50, the charge roller 52, the developing roller 54, the transfer roller 74, and the cleaning blade 57 are disposed around the photosensitive drum 51 in this order with respect to a rotating direction (e.g., counterclockwise in FIG. 1) of the photosensitive drum 51.

The cleaning unit 60 is disposed below the conveying belt 73. The cleaning unit 60 is configured to collect toner adhering to the conveying belt 73 by sliding of the cleaning unit 60 and the conveying belt 73 relative to each other.

The fixing unit 80 is disposed further to the rear than the plurality of process units 50 and the transfer unit 70. The fixing unit 80 includes a heat roller 81 and a pressure roller 82. The pressure roller 82 faces the heat roller 81 and presses the heat roller 81.

For color printing, in the image forming unit 30, the circumferential surface of each of the photosensitive drums 51 is uniformly and positively charged by each corresponding charge roller 52 and is then exposed to a laser beam emitted by the scanner 40. As a result of the exposure, in each of the photosensitive drums 51, both positive and negative charge is generated inside the photosensitive layer 51B (refer to FIG. 3) and the negative charges are transported toward an outer surface of the photosensitive layer 51B. Thus, some of the positive charge accumulated on the outer surface of the photosensitive layer 51B in charging is cancelled out by some negative charge transported to the outer surface of the photosensitive layer 51B and therefore an electrostatic latent image is formed on each of the photosensitive drums 51. Thereafter, each of the developing rollers 54 supplies toner onto the circumferential surface of each of the corresponding photosensitive drums 51 from the developing unit 520 to form a toner image on the circumferential surface of each of the photosensitive drums 51.

When a sheet P placed on the conveyor belt 72 passes between each pair of photosensitive drum 51/transfer roller 74 pair, the toner image formed on each of the photosensitive drums 51 is transferred onto the sheet P. For monochrome printing, in the image forming unit 30, the same or similar operation is performed on the components to be involved in printing in black K. Thereafter, when the sheet P passes between the heat roller 81 and the pressure roller 82, the toner images transferred on the sheet P are thermally fixed thereon.

The discharge unit 90 includes a plurality of conveying rollers 91 for conveying a sheet P. The conveying rollers 91 convey a sheet P, on which a toner image has been transferred and thermally fixed, and discharge the sheet P to the outside of the housing 10.

As illustrated in FIG. 3, the color printer 1 further includes a charge voltage application circuit 210, a drum driving mechanism 220, a developing voltage application circuit 230, and a transfer voltage application circuit 240, as well as the controller 100. The charge voltage application circuit 210, the drum driving mechanism 220, the developing voltage application circuit 230, and the transfer voltage application circuit 240 are each electrically connected to controller 100.

The charge voltage application circuit 210 is configured to apply a first charge voltage and a second charge voltage to the charge roller 52. The first and second charge voltages may be a positive voltage (as an example of a first polarity). The charge voltage application circuit 210 is further configured to apply a reverse charge voltage to the charge roller 52. The reverse charge voltage may be a negative voltage (as an example of a second polarity). When the charge voltage application circuit 210 applies the first charge voltage or the second charge voltage to the charge roller 52, the circumferential surface of the photosensitive drum 51 is positively charged. When the charge voltage application circuit 210 applies the reverse charge voltage to the charge roller 52, the circumferential surface of the photosensitive drum 51 is negatively charged.

The drum driving mechanism 220 is configured to rotate the photosensitive drums 51, and includes, for example, a motor, gears, and a clutch. The drum driving mechanism 220 is electrically connected to each of the photosensitive drums 51.

The developing voltage application circuit 230 is configured to apply a positive developing bias to each of the developing rollers 54. The developing voltage application circuit 230 is electrically connected to each of the developing rollers 54. Developing bias to be applied during printing is lower than the charge voltage and higher than a surface potential of an exposed portion of the photosensitive drum 51. The transfer voltage application circuit 240 is configured to apply a negative transfer voltage to each of the transfer rollers 74. The transfer voltage application circuit 240 is electrically connected to each of the transfer rollers 74.

The controller 100 includes, for example, a CPU, a ROM, and a RAM. The controller 100 is configured to, in response to receipt of a print instruction, output a control signal to each of the image forming unit 30 and the discharge unit 90 in accordance with predetermined programs. The controller 100 is configured to execute image formation for forming a toner image onto a sheet P, and accumulated charge removal for removing accumulated charges from the inside of the photosensitive layer 51B of each of the photosensitive drums 51. The controller 100 is configured to, when executing the image formation or the accumulated charge removal, control the drum driving mechanism 220 to rotate the photosensitive drums 51.

Figure 5A:
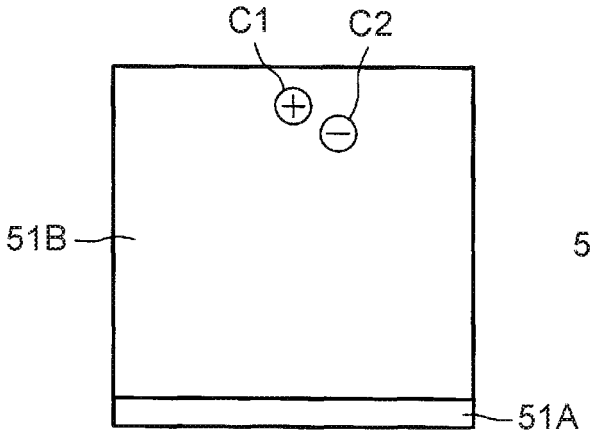
FIGS. 5A and 5B show principles of how charges are generated and accumulated inside a photosensitive layer in the first illustrative embodiment according to one or more aspects of the disclosure.
Figure 5B:
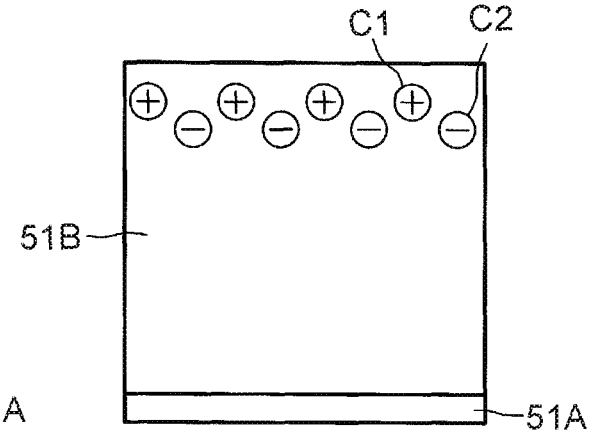

Accumulated charges may be positive and negative charges generated inside the photosensitive layer 51B due to, for example, sliding of the photosensitive drum 51 relative to the cleaning blade 57. As illustrated in FIGS. 5A and 5B, accumulated charges C1 and C2 may increase gradually every time the photosensitive drum 51 slides relative to the cleaning blade 57. The accumulated charges C1 and C2 generated as such do not tend to move freely, and therefore, it is conceivable that even if an electric field is generated and acts on the accumulated charges C1 and C2 in charging, the accumulated charges C1 and C2 do not move from their positions and may accumulate in the proximity of the outer surface of the photosensitive layer 51B.

The controller 100 is further configured to execute first charging, first exposure, developing, and transferring in the image formation. The controller 100 is further configured to execute reverse charging, toner-supply suspension, second exposure, and second charging in the accumulated charge removal. In other words, the controller 100 implements those operations by operating in accordance with the programs. Further, a control method executed by the controller 100 includes steps for executing the above operations.

Hereinafter, the operations executed in the image formation will be described in detail by taking one of photosensitive drums 51 involved in the monochrome mode as an example. When the image formation is performed in the color mode, the same operations are executed on all of the photosensitive drums in the image formation. The first charging is for charging the circumferential surface of the photosensitive drum 51 positively using the corresponding charge roller 52. More specifically, the first charging is a pre-operation or preparatory operation for the first exposure to be executed based on image data. That is, the first charging is for charging a portion of the circumferential surface of the photosensitive drum 51 to an appropriate surface potential using the scanner 40 during a period from start to end of the first exposure.

Figure 4:
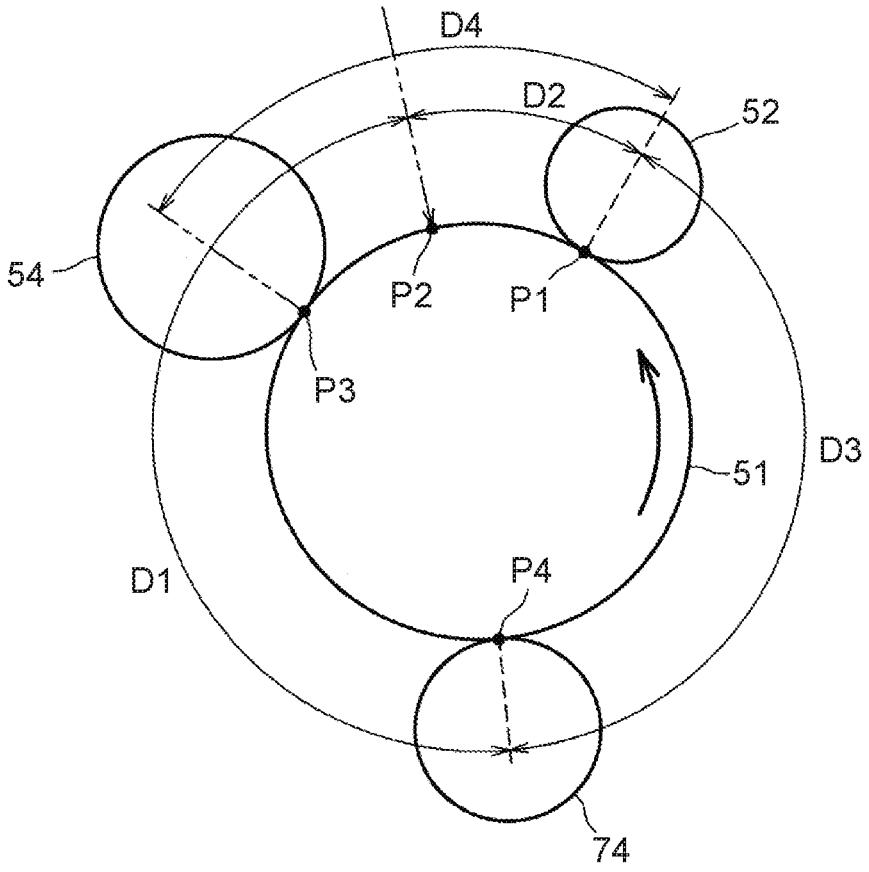
FIG. 4 illustrates a positional relationship between one of the photosensitive drums and its surrounding rollers in the first illustrative embodiment according to one or more aspects of the disclosure.

As illustrated in FIG. 4, a first position P1 is a position at which the photosensitive drum 51 and the charge roller 52 contact each other. A second position P2 is a contact point at which a laser beam emitted from the scanner 40 (refer to FIG. 1) with contacts the circumferential surface of the photosensitive drum 51. The first position P1 is positioned upstream from the second position P2 in the rotating direction of the photosensitive drum 51. The first position P1 is spaced from the second position P2 by a second distance D2 in a circumferential direction of the photosensitive drum 51. Therefore, a length of a second period of time T2 required for a portion, which is positioned at the first position P1 when charging starts, of the photosensitive drum 51K to arrive at the second position P2 may be expressed by Expression (1).

$$T2=D2/S \quad (1)$$

D2: a partial circumference of the circumferential surface of the photosensitive drum 51. This partial circumference is the length of a line that extends downstream along the circumferential surface of the photosensitive drum 51 from the first position P1 to the second position P2 inclusive in the rotating direction of the photosensitive drum 51, and S: a peripheral speed of the photosensitive drum 51.

Figure 9:
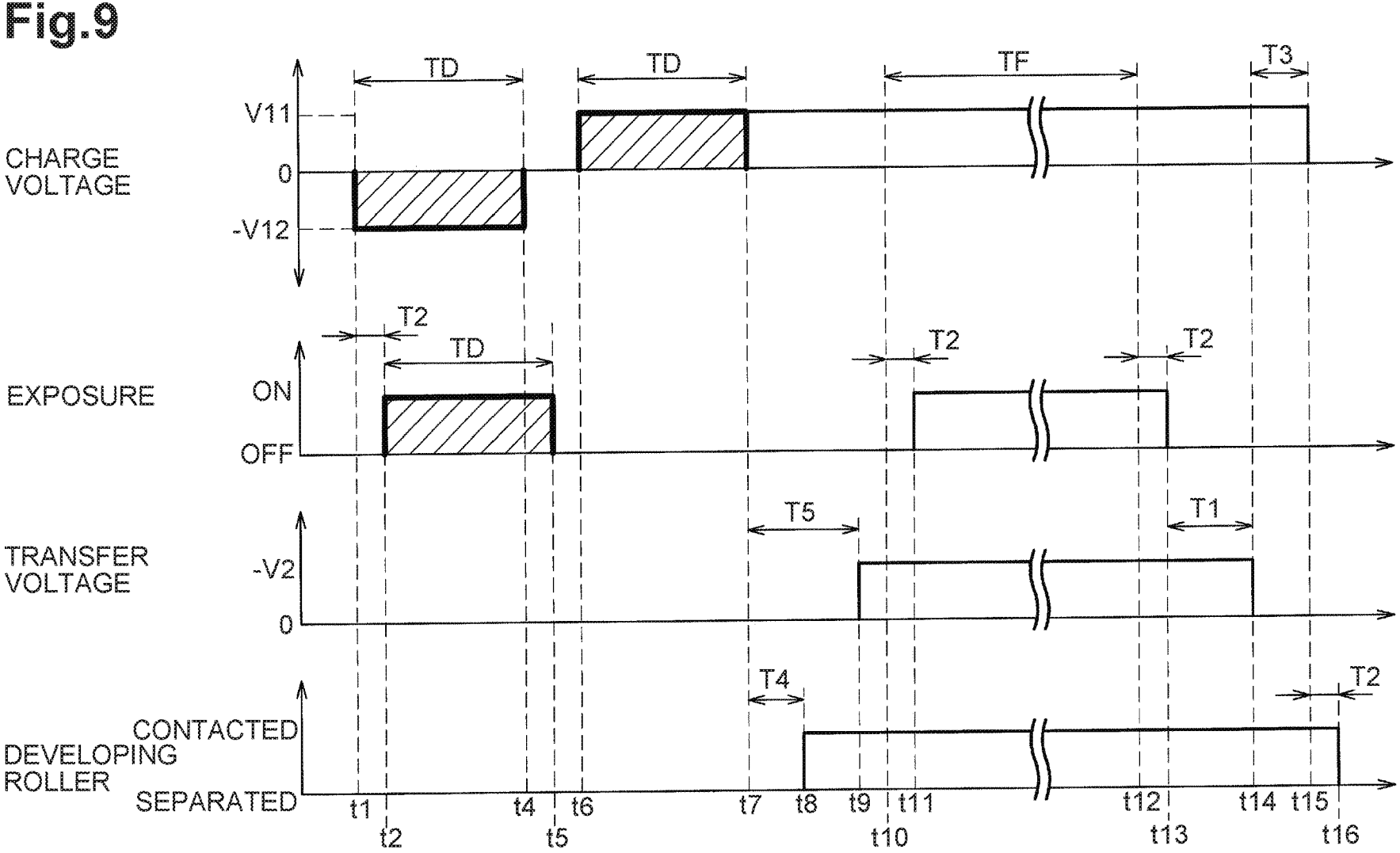
FIG. 9 is a timing diagram of the operations executed by the controller in the first illustrative embodiment according to one or more aspects of the disclosure.

Therefore, as illustrated in FIG. 9, the first charging may be executed at least for a period TF, which may last from a timing (e.g., timing t10) that is the second period T2 earlier than the start of the first exposure to a timing (e.g., timing t12) that is the second period T2 earlier than the end of the first exposure. In the illustrative embodiment, the first charging is executed for a period which lasts from timing t7, which is earlier than timing t10, to timing t15, which is later than timing t12.

The controller 100 controls the charge voltage application circuit 210 to apply a first charge voltage to the charge roller 52. More specifically, for example, in response to receipt of a print instruction, the controller 100 outputs, to the charge voltage application circuit 210, a control signal responsive to the first charge voltage. In response to the control signal outputted from the controller 100, the charge voltage application circuit 210 applies a first charge voltage to the charge roller 52. In the illustrative embodiment, the first charge voltage is a predetermined voltage V11. The predetermined voltage V11 may be, for example, 1500V.

In the illustrative embodiment, upon lapse of a third period T3 from the end of the transferring, the controller 100 ends the first charging. The third period T3 may be expressed by Expression (2).

$$T3=D3/S \quad (2)$$

D3: a partial circumference of the circumferential surface of the photosensitive drum 51. This partial circumference is the length of a line that extends downstream along the circumferential surface of the photosensitive drum 51 from a fourth position P4 (refer to FIG. 4) to the first position P1 inclusive in the rotating direction of the photosensitive drum 51, and S: a peripheral speed of the photosensitive drum 51.

The fourth position P4 is a position at which the transfer roller 74 and the circumferential surface of the photosensitive drum 51 sandwich the conveying belt 73 therebetween.

Further continuing the first charging for the third period T3 beyond the end of the transferring may enable charging of the entire circumferential surface of the photosensitive drum 51 to a predetermined surface potential uniformly, and thus the entire circumferential surface of the photosensitive drum 51 may have substantially the same surface potential when printing ends.

The first exposure is for forming an electrostatic latent image onto the circumferential surface of the photosensitive drum 51 by exposing the circumferential surface of the photosensitive drum 51 charged in the first charging. The controller 100 controls the scanner 40 to emit and stop emitting a laser beam based on image data corresponding to a print instruction to form an electrostatic latent image onto the circumferential surface of the photosensitive drum 51. A duration of an execution period of the first exposure varies according to a size of the image data to be printed. According to variations of the duration of the execution period of the first exposure, a duration of an execution period of the first charging also changes.

The developing is for forming a toner image on the circumferential surface of the photosensitive drum 51 by supplying toner onto an electrostatic latent image by the developing roller 54. The controller 100 controls the developing voltage application circuit 230 to apply a developing voltage to the developing roller 54 in the developing. The developing voltage may be, for example, 300 V.

The transferring is for transferring a toner image onto a recording medium/media such as sheet P. The controller 100 controls the transfer voltage application circuit 240 to apply a first transfer voltage to the transfer roller 74 in the transferring. Upon expiration of the first period T1 from the end of the first exposure, the controller 100 ends the transferring. The first period T1 may be expressed by Expression (4).

$$T1=D1/S \quad (4)$$

D1: a partial circumference of the circumferential surface of the photosensitive drum 51 which is the length of a line that extends downstream along the circumferential surface of the photosensitive drum 51 from the second position P2 to the fourth position P4 (refer to FIG. 4) inclusive in the rotating direction of the photosensitive drum 51, and S: a peripheral speed of the photosensitive drum 51.

Hereinafter, the operations executed in the accumulated charge removal will be described in detail by taking one of the photosensitive drums 51 as an example although the same operations are simultaneously executed on all of the photosensitive drums 51 in the actual operations. The reverse charging is for charging the circumferential surface of the photosensitive drum 51 negatively using the charge roller 52 while the photosensitive drum 51 rotates a full turn (e.g., 360 degrees) in a time period different from the execution period of the transferring. In the reverse charging, the controller 100 controls the charge voltage application circuit 210 to apply the reverse charge voltage having a polarity opposite to the first charge voltage to the charge roller 52. In the illustrative embodiment, the reverse charge voltage is a specified voltage −V12. An absolute value of the specified voltage −V12 may be, for example, the same as the predetermined value V11. The specified voltage −V12 may be, for example, −1500 V.

The controller 100 starts the reverse charging during execution of the toner-supply suspension. More specifically, in response to receipt of a print instruction, the controller 100 starts the reverse charging. In other words, subsequent to the start of the toner-supply suspension (to stop supplying toner to the photosensitive drum 51 from the developing unit 520), the controller 11 starts the reverse charging.

The toner-supply suspension is for temporarily stopping supply of toner from the developing roller 54 to the photosensitive drum 51 while the portion, which has been negatively charged in the reverse charging, of the photosensitive drum 51 passes a third position P3 (refer to FIG. 4). The third position P3 is a position at which the developing roller 54 and the circumferential surface of the photosensitive drum 51 contact with each other. More specifically, in the toner-supply suspension, the controller 100 controls the developing roller moving mechanism TM to separate the developing roller 54 from the respective photosensitive drum 51.

The controller 100 starts the toner-supply suspension subsequent to the end of the transferring. More specifically, for example, the controller 100 starts the toner-supply suspension subsequent to the end of the first charging (e.g., timing t15) (refer to FIG. 9). Upon lapse of a fourth period T4 from the start of the first charging (e.g., timing t7) (refer to FIG. 9), the controller 100 ends the toner-supply suspension. That is, the controller 100 controls the developing roller moving mechanism TM to contact the developing roller 54 to the photosensitive drum 51 (e.g., timing t8). The fourth period T4 may be expressed by Expression (3).

$$T4=D4/S \quad (3)$$

D4: a partial circumference of the circumferential surface of the photosensitive drum 51 which is the length of a line that extends downstream along the circumferential surface of the photosensitive drum 51 from the first position P1 to the third position P3 (refer to FIG. 4) inclusive in the rotating direction of the photosensitive drum 51, and S: a peripheral speed of the photosensitive drum 51.

With this control, when the portion, which has been charged at the first position P1 in the first charging, of the circumferential surface of the photosensitive drum 51 arrives at the third position P3, the developing roller 54 made to contact the photosensitive drum 51. Therefore, this control may avoid an unnecessary toner supply to the photosensitive drum 51 from the developing roller 54.

The second exposure is for, while the photosensitive drum 51 rotates a full turn, exposing, using the scanner 40, a portion, which has been negatively charged in the reverse charging, of the circumferential surface of the photosensitive drum 51 to a laser beam at the second position P2 (refer to FIG. 4). More specifically, for example, upon expiration of the second period T2 from the start of the reverse charging, the controller 100 starts the second exposure.

The controller 100 ends the second exposure prior to start of the second charging. More specifically, for example, upon expiration of the specified period TD from the start of the second exposure, the controller 100 ends the second exposure.

The controller 100 controls the scanner 40 to expose an entire width of an image formable area of the photosensitive drum 51 in the second exposure. The width of the image formable area may correspond to a dimension of the image formable area of the photosensitive drum 51 in a direction in which an axis of the photosensitive drum 51 extends.

The second exposure is achieved if most of the width of the image formable area is exposed. In other words, in the second exposure, it may be unnecessary to expose the entire width of the image formable area. For example, not the entire width but between 70 percent and 90 percent of the entire width of the image formable area may be exposed in the second exposure.

The second charging is for, while the photosensitive drum 51 rotates a full turn, charging, using the charge roller 52, a portion, which has been exposed in the second exposure, of the circumferential surface of the photosensitive drum 51 at the first position P1. In the second charging, the controller 100 controls the charge voltage application circuit 210 to apply the second charge voltage to the charge roller 52. In the illustrative embodiment, the second charge voltage has the same value as the first charge voltage, i.e., the predetermined voltage V11. Nevertheless, in other embodiments, for example, the second charge voltage may be smaller or greater than the first charge voltage.

Hereinafter, principles of how to remove accumulated charges C1 and C2 from the photosensitive layer 51B will be described. It is assumed that some accumulated charges C1 and C2 are present inside the photosensitive layer 51B.

Figure 6A:
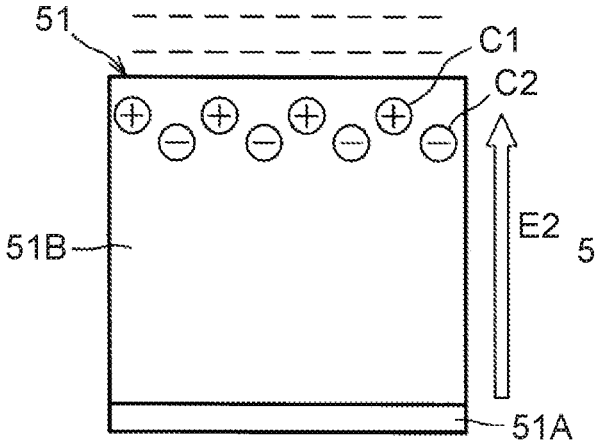
FIGS. 6A to 6E illustrate principles of how to remove accumulated charges in the first illustrative embodiment according to one or more aspects of the disclosure.

In the accumulated charge removal, as illustrated in FIG. 6A, when the reverse charging is executed, negative charges accumulate on the circumferential surface of the photosensitive drum 51 and thus the potential of the outer surface of the photosensitive layer 51B becomes negative. Therefore, a second electric field E2, which is directed toward the outer surface of the photosensitive layer 51B from the grounded cylindrical base 51A, is generated in the photosensitive layer 51B and acts on the accumulated charges C1 and C2. Nevertheless, the accumulated charges C1 and C2 stay at their positions.

Figure 6B:
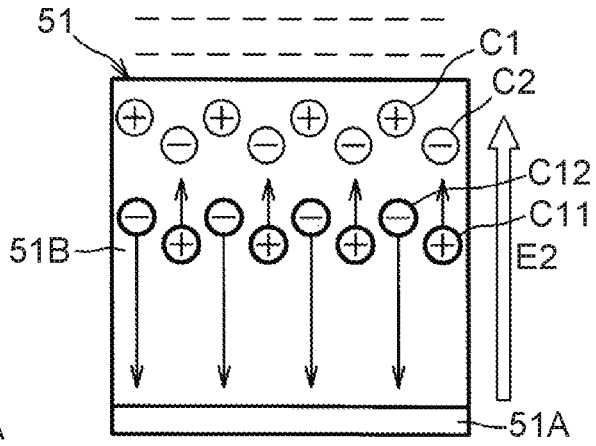

As illustrated in FIG. 6B, when the second exposure is executed subsequent to the reverse charging, positive charges C11 and negative charges C12 are generated in the photosensitive layer 51B. The positive charges C11 and negative charges C12 generated by exposure tend to move easily due to an effect of the first electric field E1.

Figure 6C:
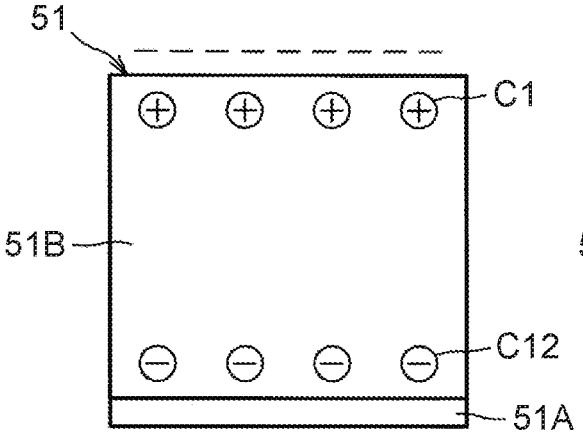

Due to the effect of the second electric field E2, the positive charges C11 move toward the outer surface of the photosensitive layer 51B. Thus, some of the positive charges C11 are attracted to the negative charges accumulating on the outer surface of the photosensitive layer 51B to cancel out each other. Some others of the positive charges C11 are attracted to the negative accumulated charges C2 in the proximity of the outer surface of the photosensitive layer 51B to cancel each other out. Thus, as illustrated in FIG. 6C, the positive accumulated charges C1 and the negative charges C12 remain in the photosensitive layer 51B after the second exposure.

Figure 6D:
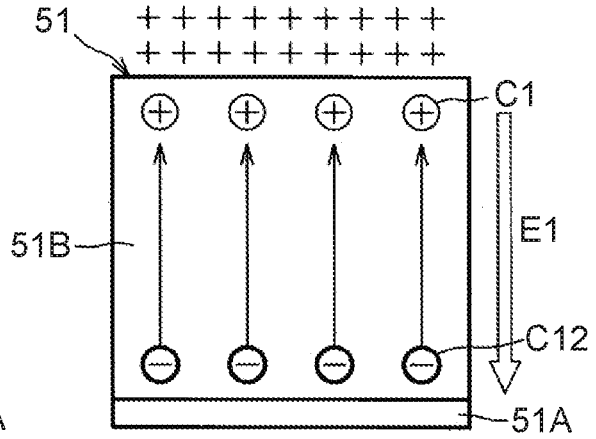
Figure 6E:
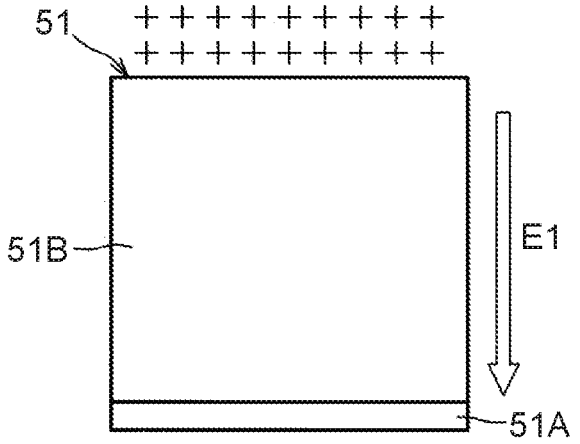

Subsequent to this, and as illustrated in FIG. 6D, when the second charging is executed, positive charges accumulate on the circumferential surface of the photosensitive drum 51 and thus the potential of the outer surface of the photosensitive layer 51B becomes positive. Therefore, a first electric field E1, which is directed toward the cylindrical base 51A from the outer surface of the photosensitive layer 51B, is generated in the photosensitive layer 51B and acts on the accumulated charges C1 and C2. Thus, the negative charges C12 move toward the outer surface of the photosensitive layer 51B due to an effect of the first electric field E1. The negative charges C12 are thus attracted to the positive accumulated charges C1 remaining in the proximity of the outer surface of the photosensitive layer 51B to cancel each other out. As a result, and as illustrated in FIG. 6E, substantially all of the accumulated charges C1 and C2 may be removed from the photosensitive layer 51B.

Figure 7:
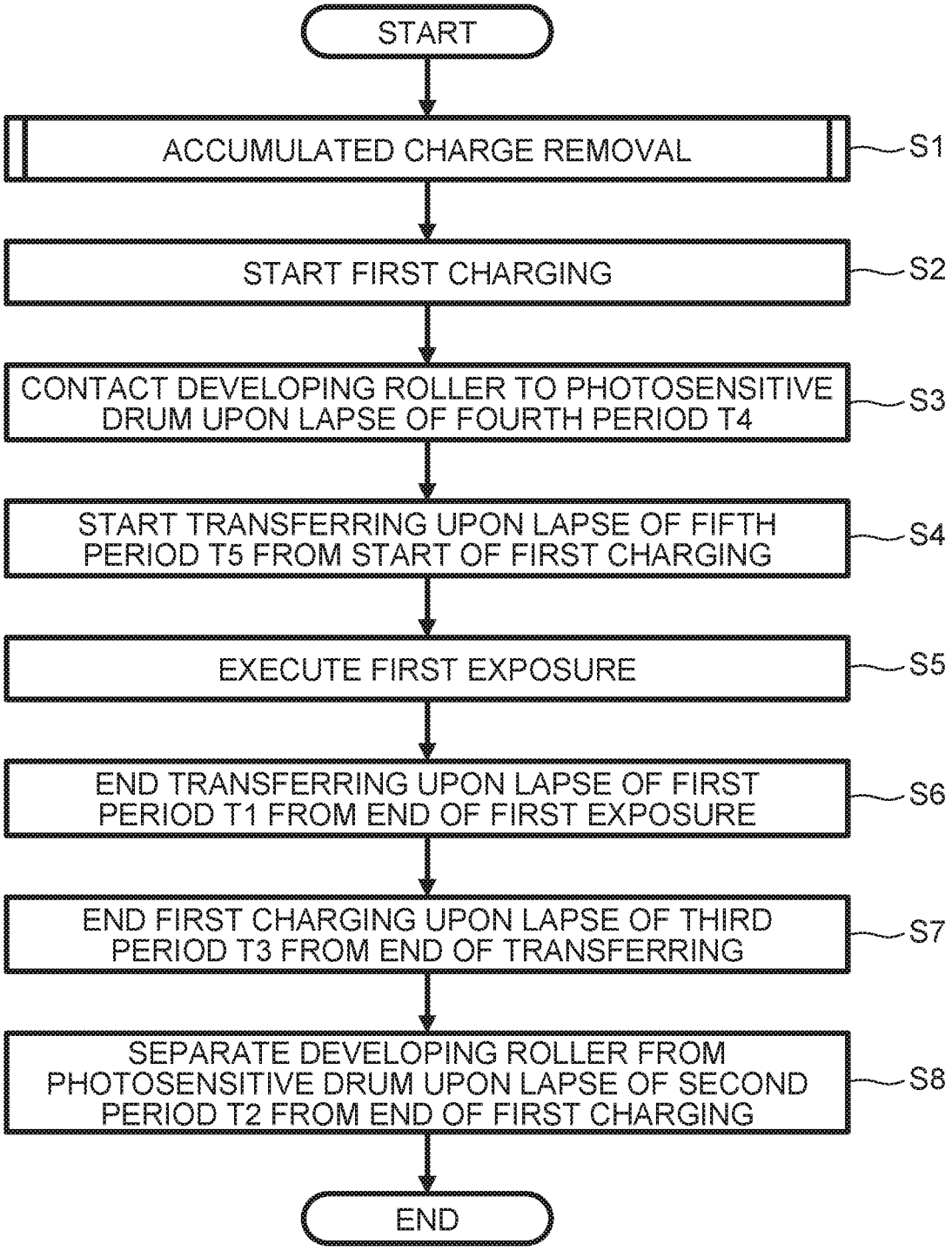
FIG. 7 is a flowchart of operations executed by a controller in the first illustrative embodiment according to one or more aspects of the disclosure.
Figure 8:
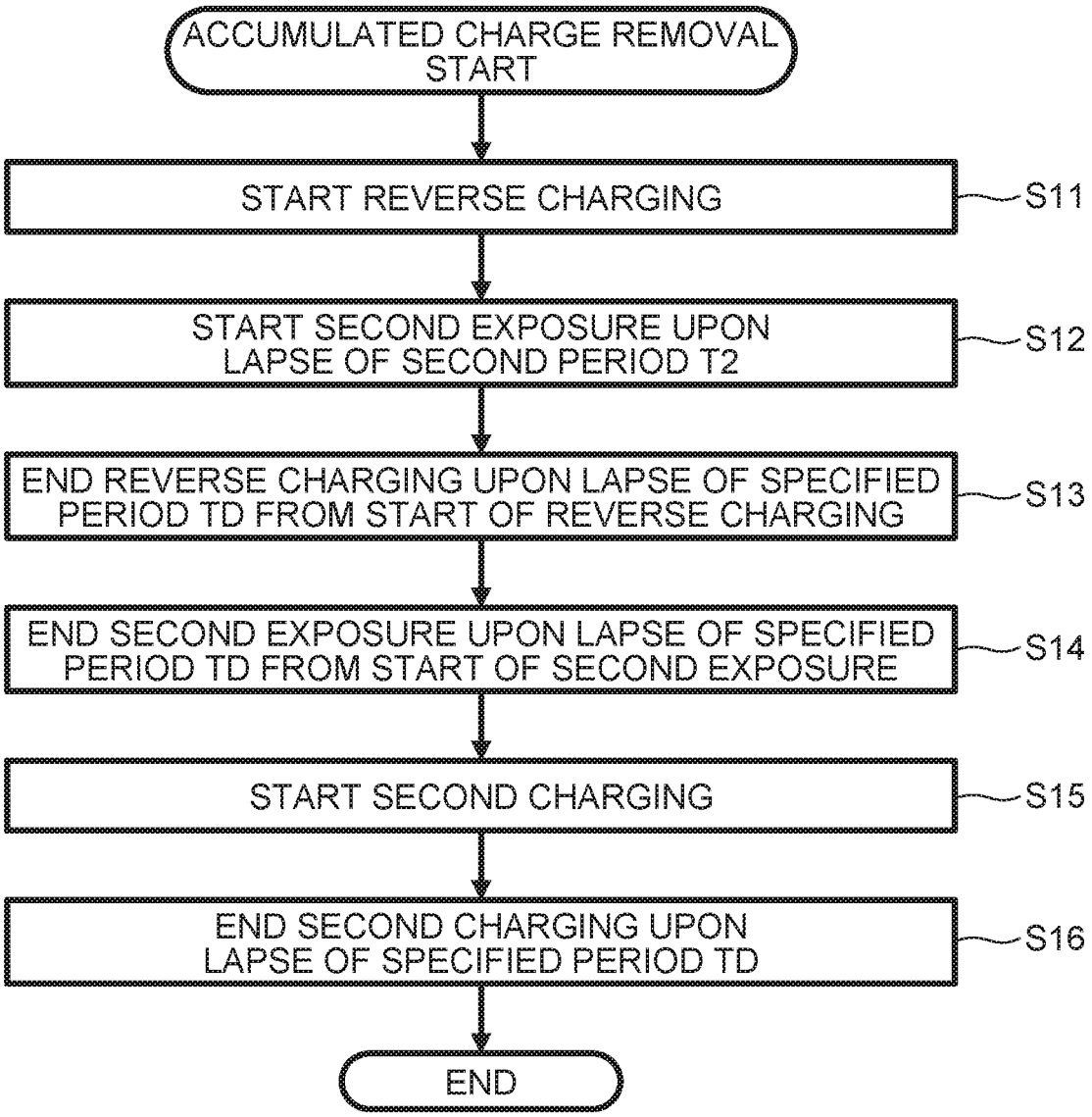
FIG. 8 is a flowchart of accumulated charge removal in the first illustrative embodiment according to one or more aspects of the disclosure.

Referring to FIGS. 7 and 8, operations to be executed by the controller 100 will be described. Until the controller 10 receives a print instruction, the controller 10 continues the toner-supply suspension, that is, the developing roller 54 is kept separated from the photosensitive drum 51.

As illustrated in FIG. 7, in response to receipt of a print instruction (e.g., START), the controller 100 executes the accumulated charge removal (e.g., step S1). As illustrated in FIG. 8, in the accumulated charge removal, the controller 100 starts the reverse charging (e.g., step S11).

Upon expiration of the second period T2 from the start of the reverse charging, the controller 100 starts the second exposure (e.g., step S12). Upon lapse of the specified period TD from the start of the reverse charging, i.e., upon completion of a full turn of the photosensitive drum 51, the controller 100 ends the reverse charging (e.g., step S13).

Upon expiration of the specified period TD from the start of the second exposure, the controller 100 ends the second exposure (e.g., step S14). Subsequent to the end of the second exposure, the controller 100 starts the second charging at an appropriate timing (e.g., step S15). Upon expiration of the specified period TD from the start of the second charging, the controller 100 ends the second charging (e.g., step S16) and thus ends the accumulated charge removal.

In response to completion of the accumulated charge removal, and as illustrated in FIG. 7, the controller 100 starts the first charging (e.g., step S2). That is, in the illustrative embodiment, the controller 100 executes the first charging (e.g., step S2) continuously from or immediately subsequent to the end of the second charging (e.g., step S16). In the first illustrative embodiment, the first charge voltage applied in the first charging and the second charge voltage applied in the second charging are specified as the same value (e.g., V11). Therefore, the same charge voltage is applied continuously from the second charging (e.g., step S16) to the first charging (e.g., step S2). Nevertheless, in a case where the first charge voltage and the second charge voltage are specified as respective different values, the voltage value of the charge voltage may be changed when the first charging starts in step S22.

Upon expiration of the fourth period T4 from the start of the first charging, the controller 100 controls the developing roller moving mechanism TM to contact the developing roller 54 to the photosensitive drum 51 (e.g., step S3). That is, in step S3, the controller 100 ends the toner-supply suspension.

Upon expiration of a fifth period T5 from the start of the first charging, the controller 100 starts the transferring (e.g., step S4). A duration of the fifth period T5 may be, for example, no shorter than a sum of the first period T1 and the second period T2. This may therefore enable application of the first transfer voltage to the portion, which has been charged at the first position P1 in the first charging, of the photosensitive drum 51, at the fourth position P4 (refer to FIG. 4). Consequently, an effect on the other portion, which has not been charged, of the photosensitive drum 51 by the first transfer voltage may be avoided.

Subsequent to step S4, the controller 100 executes the first exposure (e.g., step S5). The first exposure may start any time after expiration of the second period T2 from the start of the first charging. In the illustrative embodiment, the first exposure starts subsequent to the start of the transferring.

In step S5, the controller 100 executes the first exposure based on image data included in the print instruction. Upon completion of exposure based on the last data of the image data, the controller 100 ends the first exposure.

Subsequent to step S5, upon expiration of the first period T1 from the end of the first exposure, the controller 100 ends the transferring (e.g., step S6). Subsequent to step S6, upon expiration of the third period T3 from the end of the transferring, the controller 100 ends the first charging (e.g., step S7).

Subsequent to step S7, upon expiration of the second period T2 from the end of the first charging, the controller 100 controls the developing roller moving mechanism TM to separate the developing roller 54 from the photosensitive drum 51 (e.g., step S8) and ends the ongoing control. That is, in step S8, the controller 100 starts the toner-supply suspension.

Referring to FIGS. 9 and 10, the accumulated charge removal and the image formation will be described.

As illustrated in FIG. 9, in response to receipt of a print instruction (e.g., timing t1), the controller 100 executes the reverse charging. When the second charging starts, the developing rollers 54 are kept separated from the respective photosensitive drums 51 by the ongoing toner-supply suspension started upon completion of the last image formation.

Figure 10A:
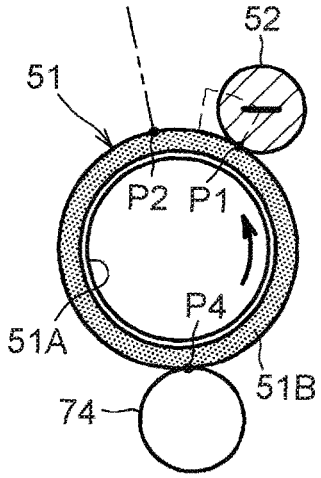
FIGS. 10A to 10G illustrate state transition of charges accumulated inside the photosensitive layer in the accumulated charge removal in the first illustrative embodiment according to one or more aspects of the disclosure.

As illustrated in FIG. 10A, in the second charging, the entire circumferential surface of the photosensitive drum 51 is negatively charged as the photosensitive drum 51 rotates a full turn. In FIGS. 10A to 10G, a negative surface potential of the photosensitive drum 51 is indicated virtually by a thin solid line, and a positive surface potential of the photosensitive drum 51 is indicated virtually by a thin dashed line.

Figure 10B:
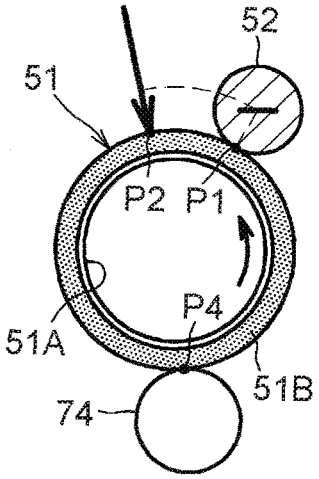

As illustrated in FIG. 9, upon lapse of the second period T2 from the start of the reverse charging, the controller 100 starts the second exposure (e.g., timing t2). Thus, as illustrated in FIG. 10B, when the portion negatively charged at timing t1 (when the second charging starts) arrives at the second position P2, the scanner 40 starts exposing the portion charged at timing t1 to a laser beam. More specifically, for example, substantially the entire width of the image formable area is exposed in the second exposure.

Figure 10C:
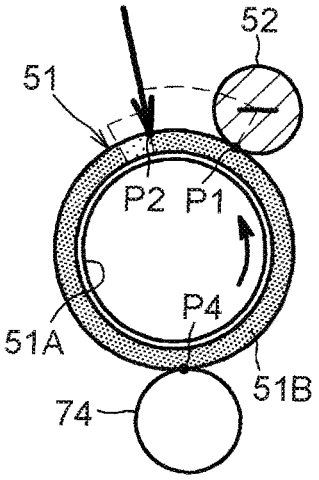

When the portion negatively charged at timing t1 is exposed in the second exposure, as illustrated in FIG. 10C, the negative accumulated charges C2 are cancelled out by the positive charges C11 generated by exposure (refer to FIGS. 6B and 6C). In FIGS. 10A to 10G, the accumulated charges C1 and C2 in the photosensitive layer 51B are indicated by dots, and dot density may correspond to an amount of accumulated charges C1 and C2 in the photosensitive layer 51B. For example, as the accumulated charges C1 and C2 decrease by removal, the dot density becomes lower.

Figure 10D:
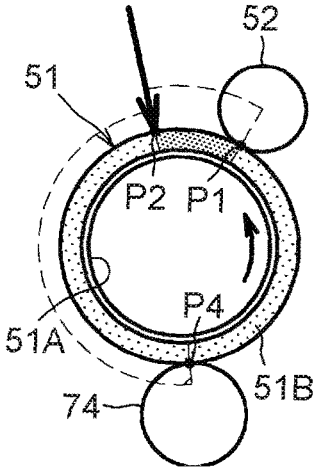

As illustrated in FIG. 9, upon expiration of the specified period TD from the start of the reverse charging (e.g., timing t1), the controller 100 ends the reverse charging (e.g., timing t4). Thus, the entire circumferential surface of the photosensitive drum 51 has undergone charging in the reverse charging, i.e., the entire circumferential surface of the photosensitive drum 51 has been negatively charged. When the reverse charging is completed, the charges may be distributed in the photosensitive layer 51B as shown in FIG. 10D. That is, when the photosensitive drum 51 completes a full turn from the start of the reverse charging, the portion negatively charged at timing t1 when the reverse charging starts has already returned to the charging roller 52 via the second position P2. Therefore, the portion that is positioned upstream from the first position P1 and downstream from the fourth position P4 in the photosensitive layer 51B in the rotating direction of the photosensitive drum 51 has undergone negative charging and exposure, and thus the accumulated charges C2 have already been removed from the portion.

Figure 10E:
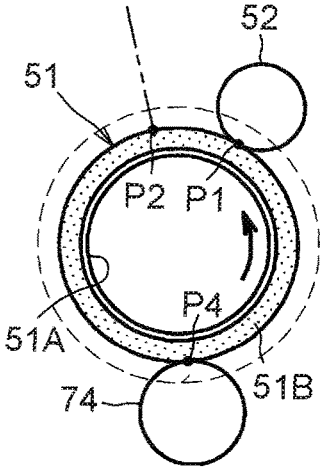

As illustrated in FIG. 9, upon expiration of the specified period TD from the start of the second exposure, the controller 100 ends the second exposure (e.g., timing t5). Thus, the entire circumferential surface of the photosensitive drum 51 has undergone exposure in the second exposure. When the second exposure is completed, the charges may be distributed in the photosensitive layer 51B as shown in FIG. 10E. That is, when the photosensitive drum 51 completes a full turn from the start of the second exposure, the portion negatively charged at timing t1 when the reverse charging starts has already returned to the second position P2. Therefore, the entire portion of the photosensitive layer 51B has undergone negative charging and exposure, and thus the negative accumulated charges C2 have already been removed from the portion.

Figure 10F:
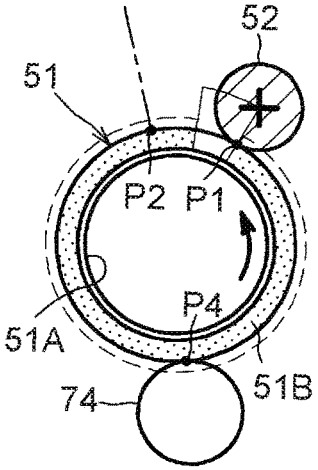

As illustrated in FIG. 9, subsequent to the end of the second exposure (e.g., timing t5), the controller 100 starts the second charging at an appropriate timing (e.g., timing t6). As illustrated in FIG. 10F, in the second charging, the entire circumferential surface of the photosensitive drum 51 is positively charged as the photosensitive drum 51 rotates a full turn. The second charging causes generation of a first electric field E1 in the photosensitive layer 51B (refer to FIG. 6D). The first electric field E1 acts on the negative charges C12 generated in the second exposure and the negative charges C12 thus move toward the outer surface of the photosensitive layer 51B. Therefore, the negative charges C12 are attracted to the positive accumulated charges C1 to cancel each other out.

Figure 10G:
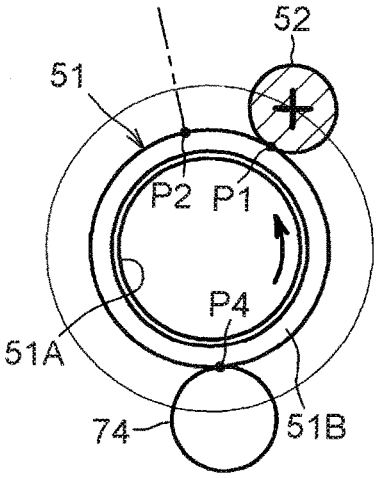

As illustrated in FIG. 9, upon expiration of the specified period TD from the start of the second charging (e.g., timing 6), the controller 100 ends the second charging (e.g., timing t7). Thus, the entire circumferential surface of the photosensitive drum 51 may receive the effect of the first electric field E1. When the second charging is completed, the charges may be distributed in the photosensitive layer 51B as shown in FIG. 10G. That is, when the photosensitive drum 51 completes a full turn from the start of the second charging, the entire portion of the photosensitive drum 51 has undergone negative charging, exposure, and positive charging. Therefore, the accumulated charges C1 and C2 have been removed from the entire portion of the photosensitive layer 51B.

Thereafter, as illustrated in FIG. 9, the image formation, including step S2 and subsequent steps of FIG. 7, is executed. That is, subsequent to the end of the second charging, the controller 100 starts the first charging (e.g., timing t7). Subsequently, upon expiration of the fourth period T4 from timing t7, the controller 100 ends the toner-supply suspension, i.e., the controller 100 controls the developing roller moving mechanism TM to contact the developing roller 54 to the photosensitive drum 51 (e.g., timing t8).

Upon expiration of the fifth period T5 from timing t7, the controller 100 starts the transferring (e.g., timing t9). Subsequent to timing t9, the controller 100 executes the first exposure based on image data at an appropriate timing (e.g., timing t11).

Subsequent to completion of the first exposure executed based on the image data (e.g., timing t13), upon expiration of the first period T1 from timing t13, the controller 100 ends the transferring (e.g., timing t14). Subsequently, upon lapse of the third period T3 from timing t14, the controller 100 ends the first charging (e.g., timing t15). Upon expiration of the second period T2 from timing t15, the controller 100 starts the toner-supply suspension, i.e., the controller 100 controls the developing roller moving mechanism TM to separate the developing roller 54 from the photosensitive drum 51, and ends the image formation.

According to the first illustrative embodiment, the following effects may be obtained.

Each of the reverse charging and the second exposure lasts for a duration equal to a length of time required for the photosensitive drum 51 to rotate a full turn. Therefore, the second electric field E2 may be enabled to act on the entire portion of the photosensitive layer 51B in the circumferential direction. As a further result, the positive charges C11 generated by exposure may be moved by the effect of the second electric field E2 to cancel out the accumulated negative charges C2. Consequently, the negative accumulated charges C2 may be removed from the photosensitive layer 51B. The second charging also lasts for a duration equal to the length of time in which the photosensitive drum 51 rotates a full turn. Therefore, the second electric field E2 may be enabled to act on the entire portion of the photosensitive layer 51B in the circumferential direction. Thus, the negative charges C12 generated by exposure may be moved by the effect of the first electric field E1 to cancel out the accumulated positive charges C1. Consequently, the accumulated positive charges C1 may be removed from the photosensitive layer 51B.

In the reverse charging, if a reverse charge voltage is applied to the transfer roller 74, a longer time period may be required for the portion negatively charged by the transfer roller 74 to arrive at the second position P2 as compared with the case of the first illustrative embodiment because the transfer roller 74 is disposed upstream from the second position P2 further than the charge roller 52. In the reverse charging according to the first illustrative embodiment, however, a reverse charge voltage having a negative polarity is applied to the charge roller 52. Therefore, as compared with the case where the reverse charging is implemented using the transfer roller 74, an interval between start of the reverse charging and end of the second exposure may be shortened in the first illustrative embodiment.

In the toner-supply suspension, the developing rollers 54 are separated from the photosensitive drums 51 and are kept in the separated state. Therefore, toner supply from the developing rollers 54 to the respective photosensitive drums 51 may be effectively stopped temporarily.

In the first illustrative embodiment, the reverse charging is started during execution of the toner-supply suspension. Therefore, this control may avoid an unnecessary toner supply to the negatively charged portion of the photosensitive drum 51. The timing at which the toner-supply suspension starts may be any timing before a portion, which has been negatively charged in the reverse charging when the reverse charging starts, arrives at the third position P3. For example, the controller 100 may start the reverse charging while not executing the toner-supply suspension and then start the toner-supply suspension subsequent to the start of the reverse charging. Nevertheless, as compared with such an example, the control according to the first illustrative embodiment may avoid an unnecessary toner supply to the negatively charged portion of the photosensitive drum 51 effectively.

The controller 100 starts the second exposure upon expiration of the second period T2 from the start of the reverse charging. Therefore, as compared with a case where the controller 100 starts the second exposure prior to expiration of the second period T2 from the start of the second charging, the control according to the first illustrative embodiment may avoid needless execution of the second exposure, which may result in minimizing power consumption.

In the first illustrative embodiment, the duration of the execution period of the reverse charging, the duration of the execution period of the second exposure, and the duration of the execution period of the second charging are equal to each other. Therefore, each of the reverse charging, the second exposure, and the second charging may be avoided to be executed needlessly.

Second Illustrative Embodiment

A second illustrative embodiment will be described with reference to appropriate accompanying drawings. In the second illustrative embodiment, details of the operations to be executed by the controller 100 may be different from those according to the first illustrative embodiment. Common components or steps have the same reference numerals or step numbers as those of the first illustrative embodiment, and the detailed description of the common components or steps is omitted.

Figure 11:
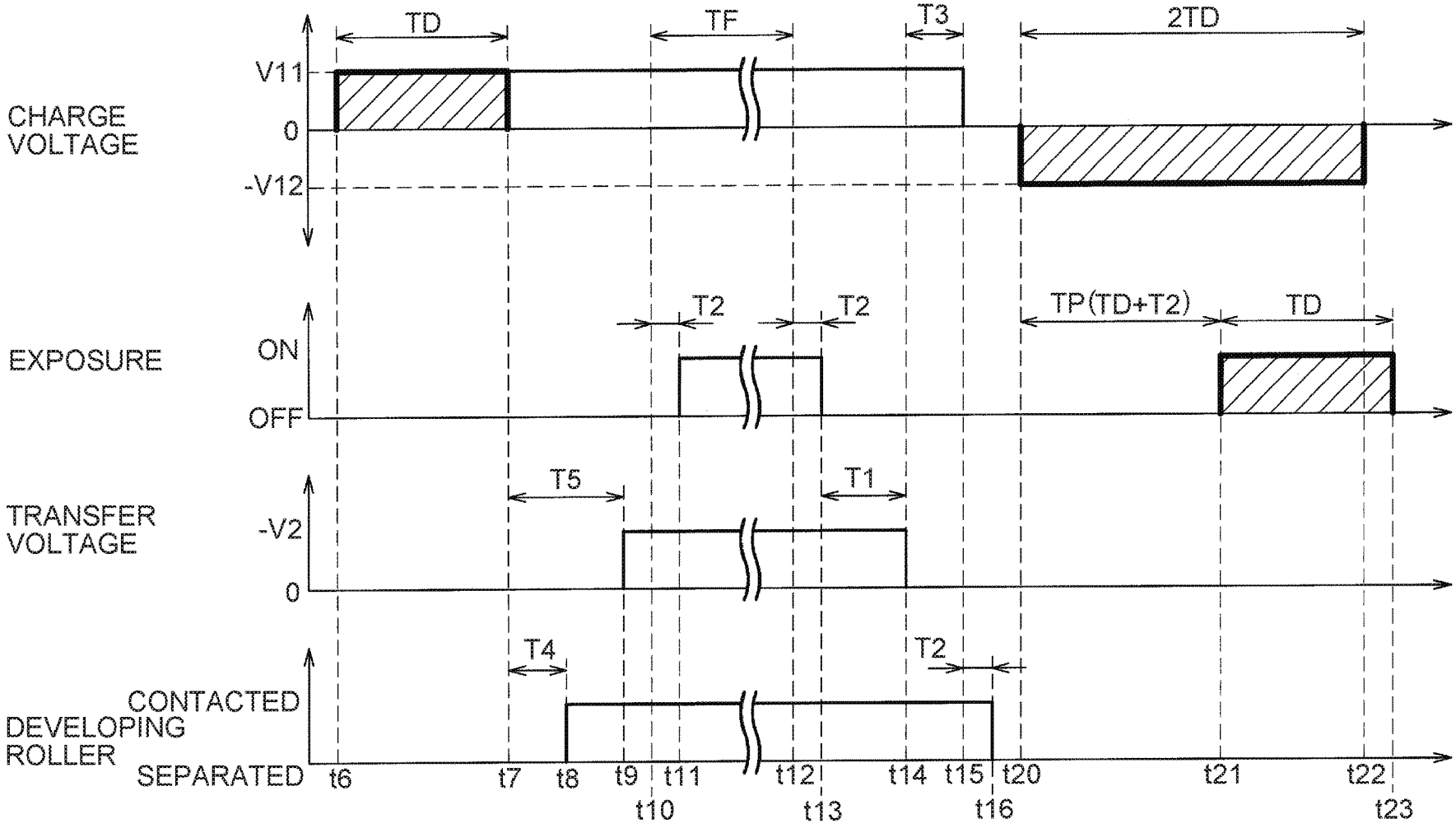
FIG. 11 is a timing diagram of operations executed by the controller in a second illustrative embodiment according to one or more aspects of the disclosure.

In the second illustrative embodiment, as illustrated in FIG. 11, subsequent to start of the toner-supply suspension (e.g., timing 16), the controller 100 executes the reverse charging and the second exposure. The controller 100 executes the reverse charging for a period 2TD, which may correspond to a period required for the photosensitive drum 51 to rotate two full turns. Upon expiration of a predetermined period TP from the start of the reverse charging (e.g., timing t20), the controller 100 starts the second exposure (e.g., timing t21). The predetermined period TP may be expressed by Expression (5).

$$TP=TD+D2/S \quad (5)$$

In the second illustrative embodiment, the charge roller 52 functions as the reverse charger. Therefore, a distance DP from a position at which the circumferential surface of the photosensitive drum 51 and the reverse charger contact with each other to the second position P2 (refer to FIG. 4) corresponds to D2.

Further, the controller 100 executes the second exposure for the period required for the photosensitive drum 51 to rotate a full turn (e.g., the specified time TD).

Figure 12:
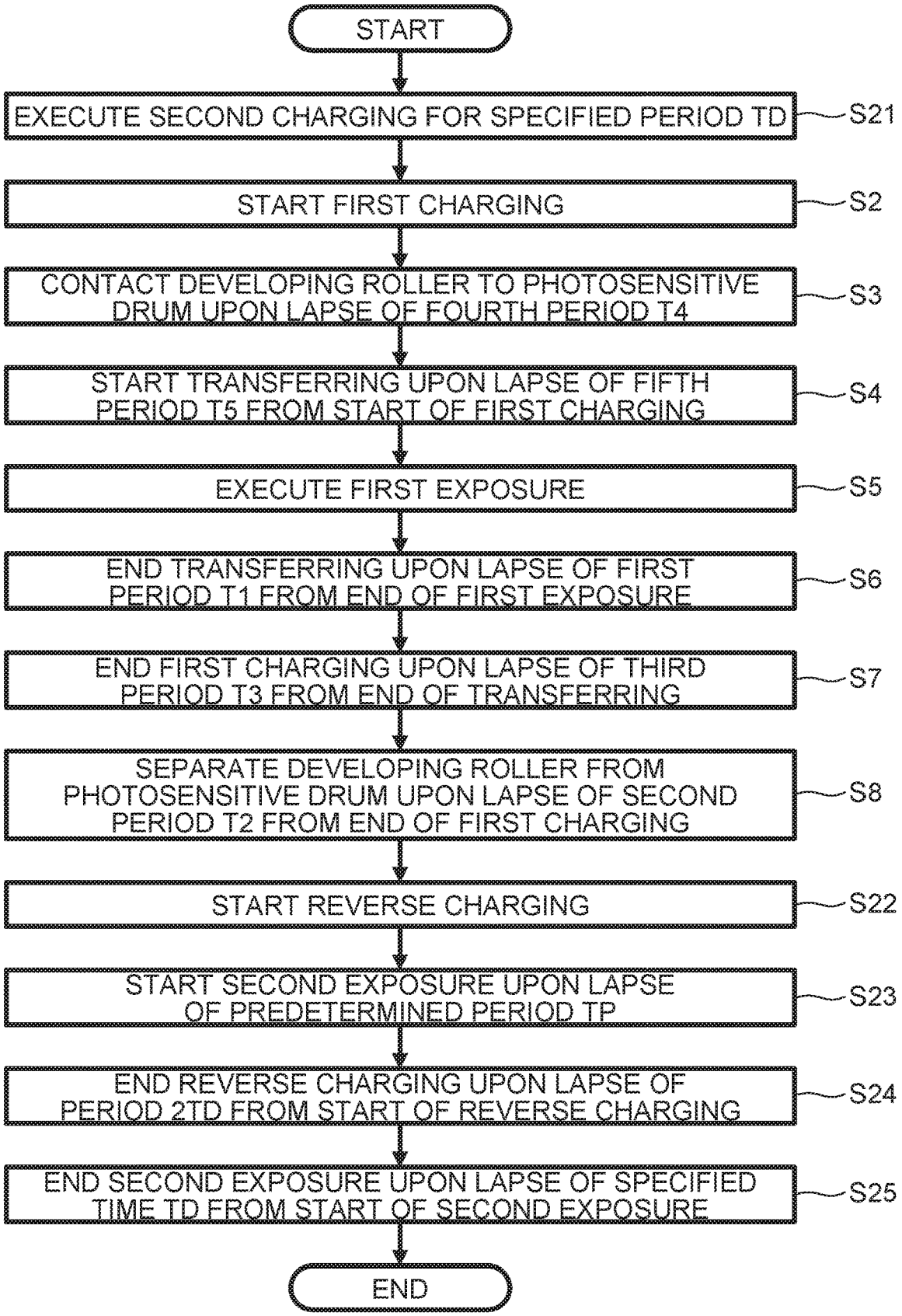
FIG. 12 is a flowchart of the operations executed by the controller in the second illustrative embodiment according to one or more aspects of the disclosure.

Referring to FIG. 12, operations to be executed by the controller 100 according to the second illustrative embodiment will be described. The flowchart of FIG. 12 includes steps S2 to S8 that are the same as the flowchart of FIG. 7 according to the first illustrative embodiment. The flowchart of FIG. 12 includes other steps S21 to S25 that are different from the flowchart of FIG. 7 according to the first illustrative embodiment. More specifically, step S21 is substituted for step S1 and steps S22 to S25 are newly added subsequent to step S8.

As illustrated in FIG. 12, in response to receipt of a print instruction (e.g., START), the controller 100 executes the second charging for the specified time TD (e.g., step S21). Subsequent to step S21, the controller 100 executes steps S2 to S8 in this order successively.

Subsequent to step S8, the controller 100 starts the reverse charging (e.g., step S22). Subsequent to step S22, upon expiration of the predetermined period TP from the start of the reverse charging, the controller 100 starts the second exposure (e.g., step S23).

Subsequent to step S23, upon expiration of the period 2TD from the start of the reverse charging, the controller 100 ends the reverse charging (e.g., step S24). Subsequent to step S24, upon expiration of the specified period TD from the start of the second exposure, the controller 100 ends the second exposure (e.g., step S25) and thus ends the ongoing control.

According to the second illustrative embodiment, the following effects may be obtained.

In the second illustrative embodiment, subsequent to the first charging for printing, the reverse charging and the second exposure are executed. Therefore, after printing is completed, the charges may be distributed in the photosensitive layer 51B as shown in FIG. 10E. Thereafter, in response to receipt of a print instruction, the controller 100 executes the second charging. As a result of this, the charges may be distributed in the photosensitive layer 51B as shown in FIG. 10G. Therefore, prior to start of the first charging, accumulated charges C1 and C2 may be removed from the photosensitive drum 51.

In the second illustrative embodiment, subsequent to the first charging for printing, the reverse charging and the second exposure are executed. Therefore, prior to start of the next printing, only the second charging is required for removing accumulated charges C1 and C2 from the inside of the photosensitive drum 51. Accordingly, an interval between receipt of a print instruction and start of printing may be shortened.

In the second illustrative embodiment, the controller 100 executes the reverse charging for the period 2TD that corresponds to the time required for the photosensitive drum 51 to rotate two full turns. Therefore, the circumferential surface of the photosensitive drum 51 that has been positively charged in the first charging may be charged to a negative potential sufficiently. While the duration of the execution period of the reverse charging is specified as the period 2TD, the duration of the execution period of the second exposure is specified as the specified period TD. Therefore, unnecessary execution of the second exposure may be avoided.

Third Illustrative Embodiment

A third illustrative embodiment will be described with reference to appropriate accompanying drawings. In the third illustrative embodiment, some configuration and details of the control to be executed by the controller 100 may be different from those according to the first illustrative embodiment. Common components or steps have the same reference numerals or step numbers as those of the first illustrative embodiment, and the detailed description of the common components or steps is omitted.

Figure 13:
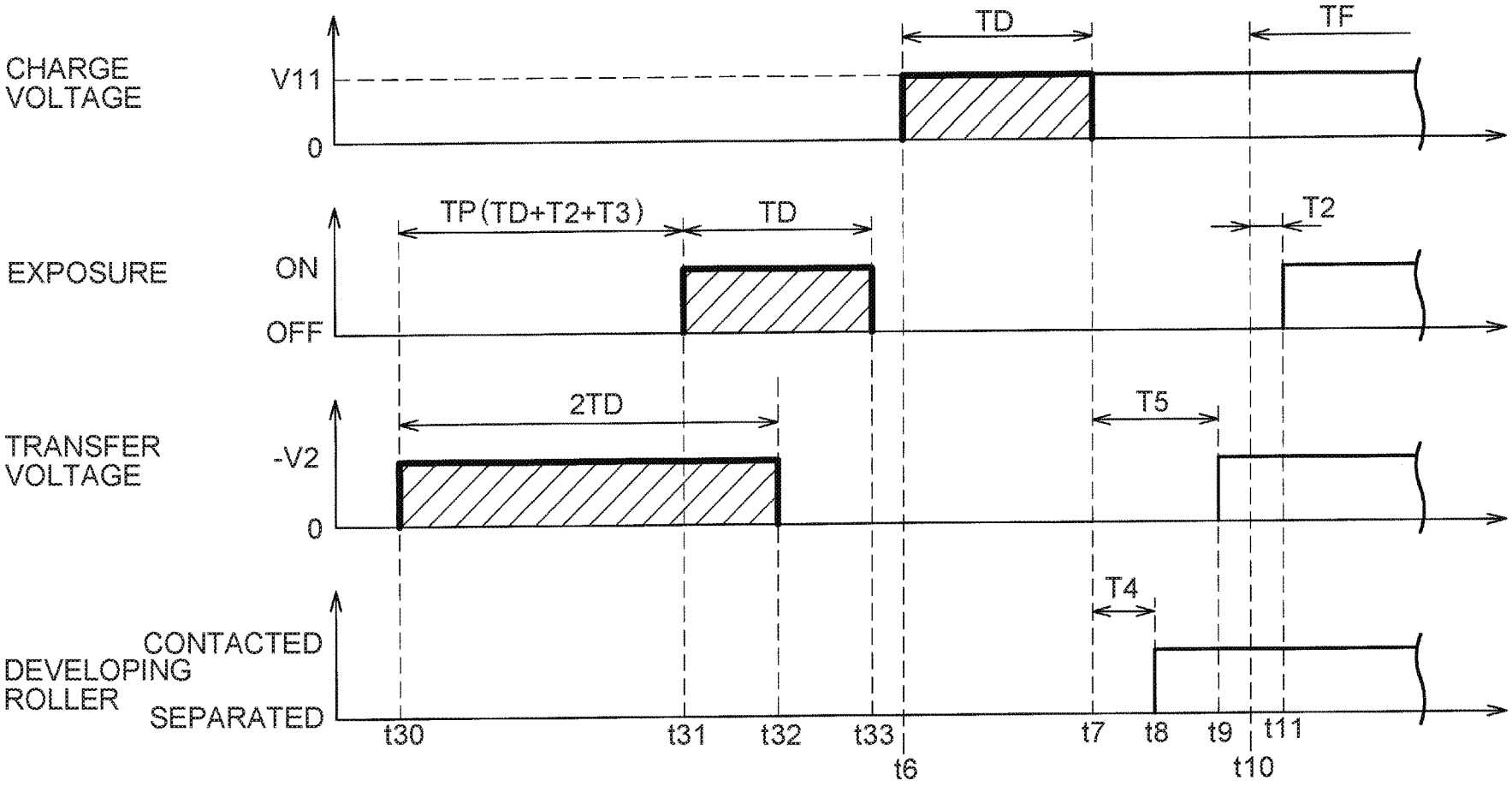
FIG. 13 is a timing diagram of operations executed by the controller in the third illustrative embodiment according to one or more aspects of the disclosure.

As illustrated in FIG. 13, the controller 100 controls the transfer voltage application circuit 240 to apply a transfer voltage having the same polarity as the first transfer voltage, e.g., a negative second transfer voltage, to the transfer roller 74 in the reverse charging. That is, in the third illustrative embodiment, the transfer roller 74 functions as the reverse charger. In the illustrative embodiment, it is assumed that a constant current control is adopted in which a transfer current that passes through the transfer roller 74 is controlled to be a constant target value, as a control for transfer voltage.

In the constant current control according to the illustrative embodiment, the controller 100 monitors a value of current passing through the transfer roller 74. Based on the monitoring, the controller 100 determines a transfer voltage to be applied to the transfer roller 74 by the transfer voltage application circuit 240 and outputs a control signal to the transfer voltage application circuit 240 based on the determined transfer voltage. The value of the transfer voltage under the constant current control may vary according to types of sheets, environmental conditions (e.g., temperature and humidity), and/or the presence or absence of a sheet. Nevertheless, for convenience of explanation, in the illustrative embodiment, the first transfer voltage and the second transfer voltage have the same value (e.g., −V2) in FIG. 13. The voltage value −V2 may be, for example, the order of −3000 V.

Nevertheless, in other embodiments, for example, the target value of the transfer current in each of the transferring and the reverse charging may be the same value or different values. In still other embodiments, for example, another constant voltage control may be adopted in which a constant transfer voltage may be applied to the transfer roller 74, as the control for transfer voltage. In this case, the first transfer voltage and the second transfer voltage may be the same value or different values.

The controller 100 executes the reverse charging for the period 2TD, which may be a time period required for the photosensitive drum 51 to rotate two full turns. Upon expiration of the predetermined period TP from the start of the reverse charging (e.g., timing t30), the controller 100 starts the second exposure (e.g., timing t31). The predetermined period TP may be expressed by Expression (6).

$$TP=TD+(D2+D3)/S \quad (6)$$

D2+D3: a partial circumference of the circumferential surface of the photosensitive drum 51. This partial circumference is the length of a line that extends upstream along the circumferential surface of the photosensitive drum 51 from the second position P2 to the fourth position P4 (refer to FIG. 4) inclusive in the rotating direction of the photosensitive drum 51.

That is, in the third illustrative embodiment, the transfer roller 74 functions as the reverse charger. Therefore, the distance DP from the second position P2 to the fourth position P4 (refer to FIG. 4) corresponds to D2+D3.

Figure 14:
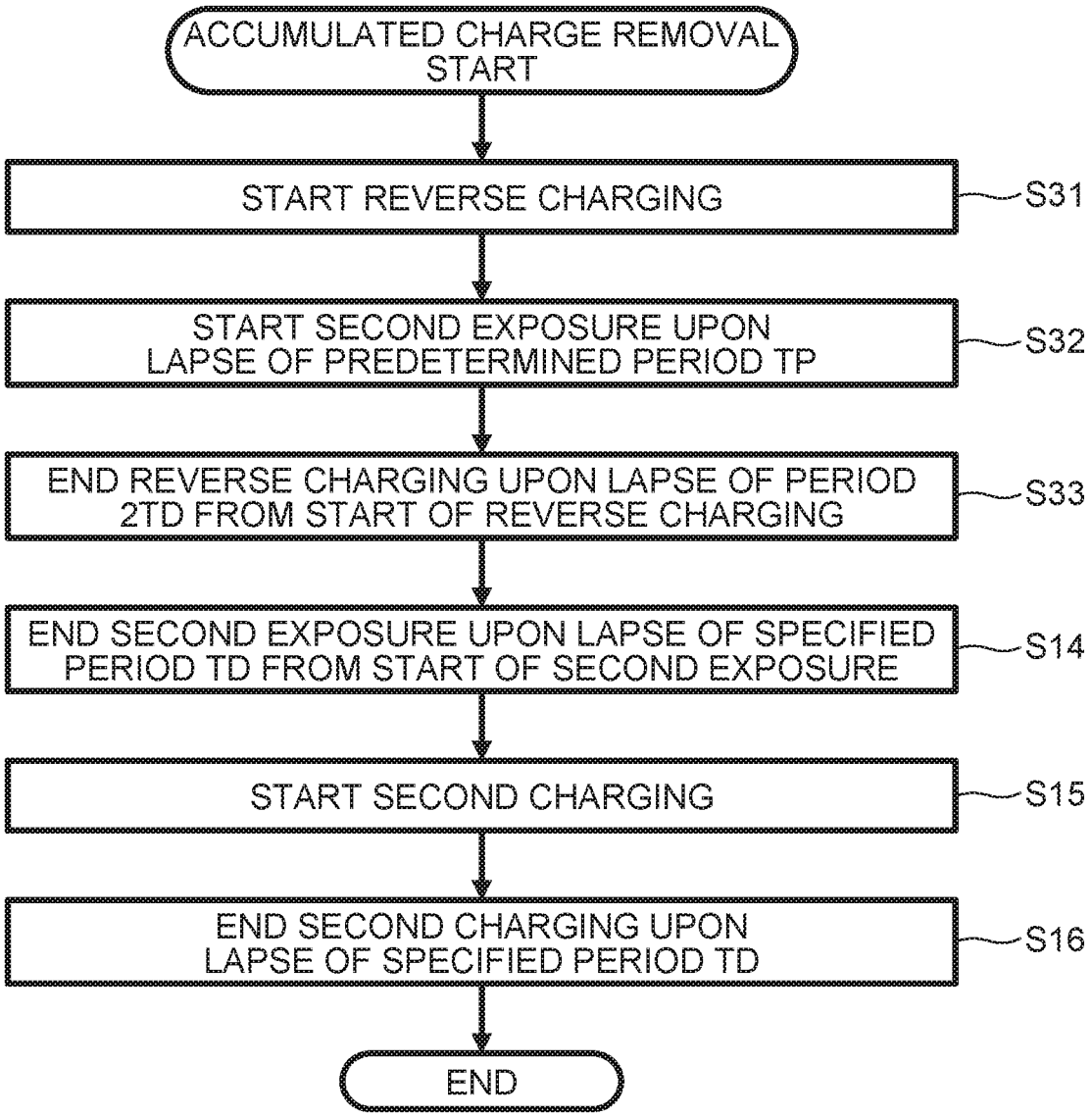
FIG. 14 is a flowchart of the operations executed by the controller in the third illustrative embodiment according to one or more aspects of the disclosure.

Referring to FIG. 14, operations to be executed by the controller 100 according to the third illustrative embodiment will be described. Accumulated charge removal of FIG. 14 includes different steps from the accumulated charge removal of FIG. 8 according to the first illustrative embodiment. The flowchart of FIG. 14 includes steps S14 to S16 that are substantially the same as the flowchart of FIG. 8. The flowchart of FIG. 15 includes other steps S31 to S33 that are different from the flowchart of FIG. 7 according to the first illustrative embodiment.

In response to receipt of a print instruction (e.g., START), the controller 100 executes the processing operation of FIG. 7. When the controller 100 executes the accumulated charge removal (e.g., step S1), the controller 100 executes steps of the flowchart of FIG. 14.

As illustrated in FIG. 14, in the accumulated charge removal, the controller 100 starts the reverse charging using the transfer roller 74 (e.g., step S31). Subsequent to step S31, upon expiration of the predetermined period TP from the start of the reverse charging, the controller 100 ends the second exposure (e.g., step S32).

Subsequent to step S32, upon expiration of the period 2TD from the start of the reverse charging, the controller 100 ends the reverse charging (e.g., step S33). Subsequent to step S33, the controller 100 executes steps S14 to S16 in this order successively.

According to the third illustrative embodiment, substantially the same effects as those obtained by the second illustrative embodiment may be obtained.

Since a component involved in printing, such as the transfer roller 74 or the charge roller 52, functions as the reverse charger in the illustrative embodiments, an increase of parts count may be avoided as compared with a case where a component that is not involved in printing functions acts as the reverse charger.

Fourth Illustrative Embodiment

A fourth illustrative embodiment will be described with reference to appropriate accompanying drawings. In the fourth illustrative embodiment, details of the reverse charging may be different from those according to the second illustrative embodiment. Common components or steps have the same reference numerals or step numbers as those of the third illustrative embodiment, and the detailed description of the common components or steps is omitted.

Figure 15:
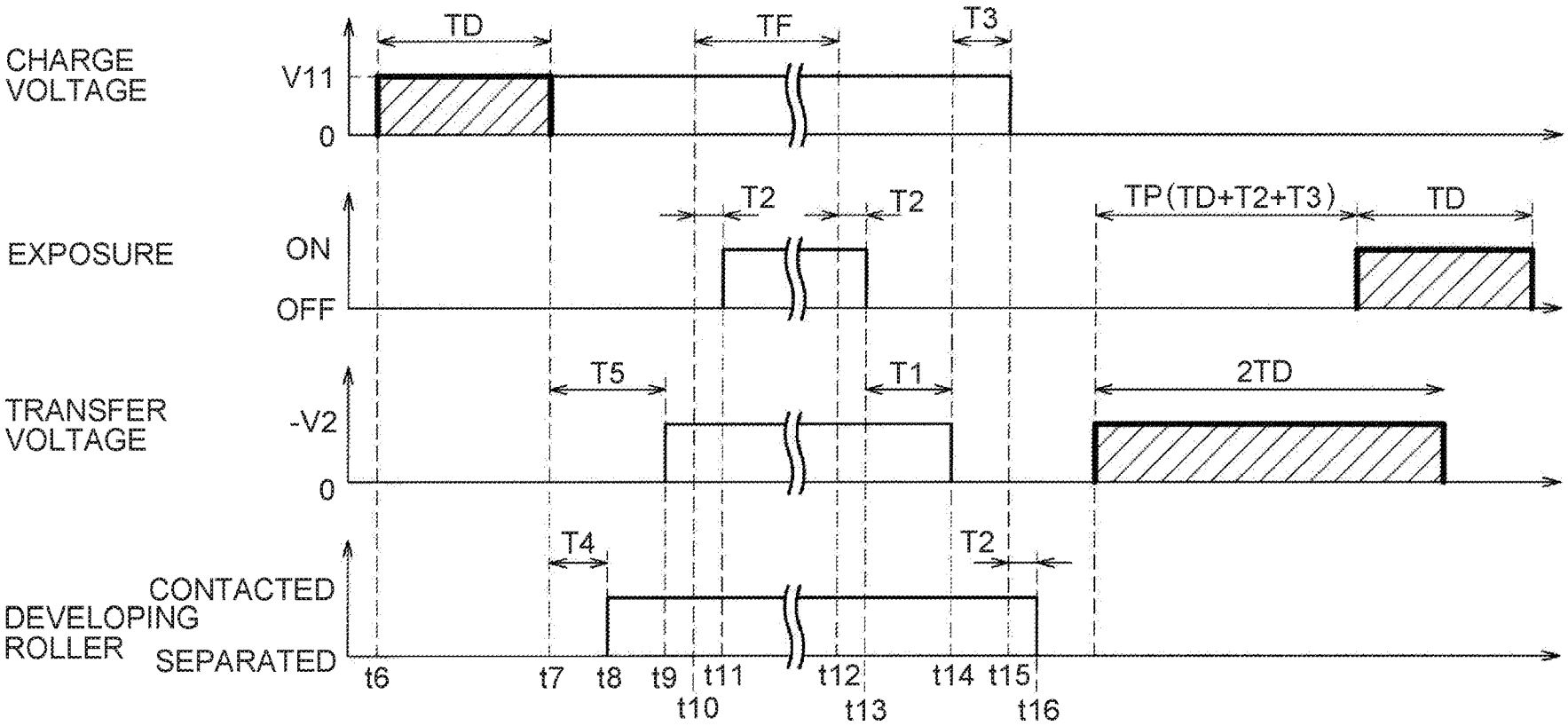
FIG. 15 is a timing diagram of operations executed by the controller in a fourth illustrative embodiment according to one or more aspects of the disclosure.

As illustrated in FIG. 15, the controller 100 implements the reverse charging by applying a negative second transfer voltage to the transfer roller 74. The other operations to be executed by the controller 100 are the same or similar to the corresponding operations according to the second illustrative embodiment. Therefore, steps included in a flowchart according to the fourth illustrative embodiment are the same or similar to steps included in the flowchart of FIG. 12. More specifically, in the reverse charging in step S22 of the fourth illustrative embodiment, the transfer roller 74 is controlled instead of the charge roller 52. According to the fourth illustrative embodiment, the same effects as those obtained by the second illustrative embodiment may be obtained.

While the disclosure has been described in detail with reference to the specific embodiments thereof, these are merely examples, and various changes, arrangements and modifications may be applied therein without departing from the spirit and scope of the disclosure.

In the second and third illustrative embodiments, the predetermined period TP satisfies the equation of TP=TD+DP/S. Nevertheless, in other embodiments, for example, the predetermined period TP may satisfy an equation of TP≥TD+DP/S.

The timing at which the developing rollers 54 are separated from the respective photosensitive drums 51, that is, the timing at the toner-supply suspension is started, may be any timing after a trailing end of the exposed portion exposed in the first exposure executed based on image data, i.e., the portion that just passed the second position P2 when the first exposure ends, arrived at the third position P3. Similar to this, the timing at which the toner-supply suspension ends may be any timing after a trailing end of the charged portion charged by the charge roller 52, i.e., the portion that just passed the first position P1 when the charging ends, arrived at the third position P3.

The start timing and/or the duration of the execution period of each of the reverse charging, the second exposure, and the second charging are not limited to the specific embodiments, but in other embodiments, for example, may be specified appropriately. For example, in the first illustrative embodiment, the reverse charging and the second exposure may be started at the same timing.

In an example of each illustrative embodiment, the first charging and the second charging may be executed successively at respective timings with no interval between their timings. In another example, the first charging and the second charging may be executed separately at respective timings with an interval during which the charge voltage is 0 (zero) being provided between their timings. Similar to this, the first exposure and the second exposure may be executed successively at respective timings with no interval between their timings or may be executed separately at respective timings with an interval being provided therebetween. The reverse charging and the first charging may be executed successively at respective timings with no interval between their timings or may be executed separately at respective timings with an interval being provided therebetween.

The developer is not limited to positively charged toner, but in other embodiments, for example, may be negatively charged toner. If negatively charged toner is used, the polarity of each voltage applied in each of the illustrative embodiments may be changed to be opposite.

The photosensitive member is not limited to the photosensitive drum 51, but in other embodiments, for example, may be a belt-shaped member.

The charger is not limited to the charge roller 53, but in other embodiments, for example, may be a corona discharge charger disposed remote from the photosensitive drum. That is, the charger may include a charge wire and a grid electrode.

The exposure device is not limited to the scanner 40, but in other embodiments, for example, may be an LED unit for exposing a photosensitive member using an LED or a static eliminator for removing static charges from the circumferential surface of the photosensitive member.

The developing unit is not limited to the developing unit 520 including the developing roller 54 contactable to the photosensitive drum 51, but in other embodiments, for example, may be a non-contactable developing unit disposed apart from the photosensitive drum 51 and including no contactable member or no portion contactable to the photosensitive drum 51.

The transfer member is not limited to the transfer roller 74, but in other embodiments, for example, may be a non-contactable transfer member disposed apart from the photosensitive drum.

The reverse charger is not limited to the charge roller 52 or the transfer roller 74, but in other embodiments, for example, may be the cleaning blade 57 or an non-contactable transfer member.

The toner-supply suspension is not limited to the specific embodiment in which the developing roller 54 is separated from the photosensitive drum 51. Nevertheless, in other embodiments, for example, the toner-supply suspension may be implemented such that the developing voltage applied to the developing roller is changed to a smaller voltage than the surface potential of the exposed portion of the photosensitive drum to temporarily stop toner supply to the photosensitive drum from the developing roller.

The image forming apparatus is not limited to the color printer 1, but in other embodiments, for example, may be a monochrome printer, a copying machine, and a multifunction device.

The transfer-receiving medium is not limited to a sheet P, but in other embodiments, for example, may be a belt that may contact the photosensitive drum in an intermediate-transfer type printer.

The one or more aspects of the disclosure may be implemented in various combinations of the elements described in the illustrative embodiments and variations.

What is claimed is:

1. An image forming apparatus comprising:

an image forming unit including:

a photosensitive member having a photosensitive layer;

a charger configured to charge a circumferential surface of the photosensitive member to a first polarity;

an exposure device comprising a light source, the exposure device configured to expose the circumferential surface of the photosensitive member;

a developing unit configured to supply developer onto the circumferential surface of the photosensitive member; and a transfer member configured to transfer the developer onto a recording medium from the circumferential surface of the photosensitive member, wherein the image forming unit is configured to perform a printing process including a first charging, a first exposure and a transferring, the transferring including transferring a developer image onto the recording medium; and a controller electrically connected to the image forming unit, the controller configured to perform:

reverse charging while the photosensitive member rotates at least a full turn, the reverse charging including charging a portion of the circumferential surface of the photosensitive member to a second polarity opposite to the first polarity, in a period different from an execution period of the transferring of the printing process;

toner-supply suspension before the portion, which has been charged to the second polarity in the reverse charging, of the circumferential surface of the photosensitive member passes a position at which developer from the developing unit is configured to initially adhere to the circumferential surface of the photosensitive member, control the developing unit to stop supplying the developer to the circumferential surface of the photosensitive member;

second exposure while the photosensitive member rotates at least a full turn, the second exposure including controlling the exposure device to expose the portion, which has been charged to the second polarity in the reverse charging, of the circumferential surface of the photosensitive member; and second charging while the photosensitive member rotates at least a full turn, the second charging including controlling the charger to charge the portion, which has been exposed in the second exposure, of the circumferential surface of the photosensitive member to the first polarity.

2. The image forming apparatus according to claim 1, further comprising:

a charge voltage application circuit electrically connected to the charger and the controller and configured to apply a charge voltage to the charger, wherein the controller is further configured to:

in the first charging, control the charge voltage application circuit to apply a first charge voltage to the charger; and in the reverse charging, control the charge voltage application circuit to apply, to the charger, a reverse charge voltage having an opposite polarity to the first charge voltage.

3. The image forming apparatus according to claim 1, further comprising:

a transfer voltage application circuit electrically connected to the transfer member and the controller and configured to apply a transfer voltage to the transfer member, wherein the controller is further configured to:

in the transferring, control the transfer voltage application circuit to apply a first transfer voltage to the transfer member; and in the reverse charging, control the transfer voltage application circuit to apply, to the transfer member, a second transfer voltage having the same polarity as the first transfer voltage.

4. The image forming apparatus according to claim 1, wherein the controller is further configured to, in the toner-supply suspension, move a developing roller of the developing unit from a first position, at which the developing roller and the circumferential surface of the photosensitive member contact with each other, to a second position, at which the developing roller is out of contact with the circumferential surface of the photosensitive member, and to maintain the developing roller in the second position.

5. The image forming apparatus according to claim 2, wherein the controller is further configured to:

execute the reverse charging for a period equal to or greater than a period required for the photosensitive member to rotate two full turns;

upon expiration of a predetermined period TP from the start of the reverse charging, start the second exposure, and wherein the predetermined period TP satisfies an equation of $TP \geq TD+DP/S$, where TD is a period required for the photosensitive member to rotate a full turn, DP is a partial circumference of the circumferential surface of the photosensitive member, the partial circumference being a length of a circumferential line that extends from a position along the circumference of the photosensitive member at which the charger generates an electric field to a position which is a point at which a light emitted from the light source intersects with the circumference of the photosensitive member, and S is a peripheral speed of the photosensitive member.

6. The image forming apparatus according to claim 5, wherein the position at which the charger generates the electric field corresponds to a position at which the charger and the circumferential surface of the photosensitive member contact with each other.

7. The image forming apparatus according to claim 3, wherein the controller is further configured to:

execute the reverse charging for a period equal to or greater than a period required for the photosensitive member to rotate two full turns;

upon expiration of a predetermined period TP from the start of the reverse charging, start the second exposure, and wherein the predetermined period TP satisfies an equation of $TP \geq TD+DP/S$, where TD is a period required for the photosensitive member to rotate a full turn, DP is a partial circumference of the circumferential surface of the photosensitive member, the partial circumference being a length of a circumferential line that extends from a position along the circumference of the photosensitive member at which the transfer member generates an electric field to a position which is a point at which a light emitted from the light source intersects with the circumference of the photosensitive member, and S is a peripheral speed of the photosensitive member.

8. The image forming apparatus according to claim 7, wherein the position at which the transfer member generates the electric field corresponds to a position at which the transfer member and the circumferential surface of the photosensitive member are closest to each other.

9. The image forming apparatus according to claim 5, wherein the controller is further configured to:

execute the reverse charging for the period equal to the period required for the photosensitive member to rotate two full turns; and execute the second exposure for the period equal to the period required for the photosensitive member to rotate a full turn.

10. The image forming apparatus according to claim 1, wherein the controller is further configured to start the reverse charging subsequent to start of the toner-supply suspension.

11. The image forming apparatus according to claim 1, wherein the controller is further configured to start and end each of the reverse charging, the second exposure and second charging prior to starting the printing process.

12. A control method to be executed by a controller of an image forming apparatus, the image forming apparatus configured to perform a printing process including a first charging, a first exposure and a transferring, the transferring including transferring a developer image onto a recording medium, the control method comprising:

reverse charging while a photosensitive member of the image forming apparatus rotates at least a full turn, the reverse charging including charging a portion of a circumferential surface of the photosensitive member to a reverse charging polarity, in a period different from an execution period of the transferring;

toner-supply suspension before the portion, which has been charged to the reverse charging polarity in the reverse charging, of the circumferential surface of the photosensitive member passes a position at which developer from a developing unit of the image forming apparatus is configured to initially adhere to the circumferential surface of the photosensitive member, the toner-supply suspension including controlling the developing unit to stop supplying the developer to the circumferential surface of the photosensitive member;

second exposure while the photosensitive member rotates at least a full turn, the second exposure including controlling an exposure device having a light source to expose the portion, which has been charged to the reverse charging polarity in the reverse charging, of the circumferential surface of the photosensitive member; and second charging while the photosensitive member rotates at least a full turn, the second charging including controlling a charger to charge the portion, which has been exposed in the second exposure, of the circumferential surface of the photosensitive member to a charging polarity opposite to the reverse charging polarity, at the position.

13. A non-transitory computer-readable storage medium storing computer-readable instructions, the computer-readable instructions executable by a processor of an image forming apparatus, the image forming apparatus configured to perform a printing process including a first charging, a first exposure and a transferring, the transferring including transferring a developer image onto a recording medium, wherein the instructions, when executed by the processor, cause the image forming apparatus to perform:

reverse charging while a photosensitive member of the image forming apparatus rotates at least a full turn, the reverse charging including charging a portion of a circumferential surface of the photosensitive member to a reverse charging polarity, in a period different from an execution period of the transferring;

toner-supply suspension before the portion, which has been charged to the reverse charging polarity in the reverse charging, of the circumferential surface of the photosensitive member passes a position at which developer from a developing unit of the image forming apparatus is configured to initially adhere to the circumferential surface of the photosensitive member, the toner-supply suspension including controlling the developing unit to stop supplying the developer to the circumferential surface of the photosensitive member;

second exposure while the photosensitive member rotates at least a full turn, the second exposure including controlling an exposure device having a light source to expose the portion, which has been charged to the reverse charging polarity in the reverse charging, of the circumferential surface of the photosensitive member; and second charging while the photosensitive member rotates at least a full turn, the second charging including controlling a charger to charge the portion, which has been exposed in the second exposure, of the circumferential surface of the photosensitive member to a charging polarity opposite to the reverse charging polarity, at the position.

* * * * *